US009724915B2

(12) United States Patent
Kyotani et al.

(10) Patent No.: US 9,724,915 B2
(45) Date of Patent: Aug. 8, 2017

(54) LIQUID EJECTION APPARATUS, STORAGE MEDIUM, AND CONTROL METHOD

(71) Applicants: Tadao Kyotani, Nagoya (JP); Yosuke Imanishi, Nagoya (JP)

(72) Inventors: Tadao Kyotani, Nagoya (JP); Yosuke Imanishi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 80 days.

(21) Appl. No.: 13/956,117

(22) Filed: Jul. 31, 2013

(65) Prior Publication Data

US 2014/0035983 A1 Feb. 6, 2014

(30) Foreign Application Priority Data

Jul. 31, 2012 (JP) ..... 2012-170084
Sep. 28, 2012 (JP) ..... 2012-217810

(51) Int. Cl.
*B41J 2/07* (2006.01)
*B41J 2/165* (2006.01)
*B41J 2/17* (2006.01)

(52) U.S. Cl.
CPC ..... *B41J 2/07* (2013.01); *B41J 2/16526* (2013.01); *B41J 2/16585* (2013.01); *B41J 2/1721* (2013.01); *B41J 2002/1742* (2013.01)

(58) Field of Classification Search
CPC ..... B41J 2/16526
See application file for complete search history.

(56) References Cited

U.S. PATENT DOCUMENTS

2005/0068364 A1 3/2005 Kayanaka
2008/0316237 A1* 12/2008 Jeon ..... B41J 2/16517 347/9

(Continued)

FOREIGN PATENT DOCUMENTS

JP 2000-238285 A 9/2000
JP 2001-018407 A 1/2001

(Continued)

OTHER PUBLICATIONS

English machine translaition of JP 2009-101594 retrieved Aug. 18, 2015.*

(Continued)

*Primary Examiner* — Manish S Shah
*Assistant Examiner* — Jeffrey C Morgan
(74) *Attorney, Agent, or Firm* — Baker Botts L.L.P.

(57) ABSTRACT

A controller is configured to: (a) control a head according to a recording command received to eject liquid through ejection openings toward a recording medium; (b) control a discharger to discharge the liquid toward a receiving member through at least one of the ejection openings; (c) determine whether a remaining amount representing an amount of the liquid on the receiving member and based at least on an amount of the liquid discharged onto the receiving member in the step (b) is equal to or greater than a first predetermined amount; and (d) control the remover to remove the liquid on the receiving member. The controller is configured to perform the step (a) before the step (d) when it is determined in the step (c) that the remaining amount is less than the first predetermined amount.

19 Claims, 14 Drawing Sheets

(56) References Cited

U.S. PATENT DOCUMENTS

| | | | | |
|---|---|---|---|---|
| 2010/0214597 | A1* | 8/2010 | Hasseler | B41J 29/38<br>358/1.15 |
| 2011/0227980 | A1 | 9/2011 | Saitoh et al. | |

FOREIGN PATENT DOCUMENTS

| | | | |
|---|---|---|---|
| JP | 2002-113851 | * | 4/2002 |
| JP | 2005-103987 | A | 4/2005 |
| JP | 2005-131873 | A | 5/2005 |
| JP | 2008221796 | A | 9/2008 |
| JP | 2008-246942 | A | 10/2008 |
| JP | 2008229863 | A | 10/2008 |
| JP | 2008238431 | A | 10/2008 |
| JP | 2009-101594 | A | 5/2009 |
| JP | 2011213095 | A | 10/2011 |

OTHER PUBLICATIONS

English Machine translation of JP 2008-221796, dated Apr. 18, 2016.*

Japan Patent Office; Office Action issued for Japanese Patent Application No. 2012-170084, mailed Jan. 26, 2016.

Japan Patent Office; Office Action issued for Japanese Patent Application No. 2012-217810, mailed Jan. 5, 2016.

* cited by examiner

LIQUID EJECTION APPARATUS, STORAGE MEDIUM, AND CONTROL METHOD

CROSS REFERENCE TO RELATED APPLICATION

This application claims priority from Japanese Patent Applications No. 2012-170084 and No. 2012-217810, which ware filed on Jul. 31, 2012 and Sep. 28, 2012, respectively, the disclosure of which is herein incorporated by reference in its entirety.

BACKGROUND OF THE INVENTION

1. Field of the Invention

The present invention relates to a liquid ejection apparatus, a storage medium, and a control method.

2. Description of Related Art

In liquid ejection apparatuses equipped with a head having a plurality of ejection openings for ejecting a liquid, a technique is known that discharges a liquid through ejection openings for purposes such as adjusting the meniscus in the ejection openings, and discharging a liquid that has dried and thickened in the head. The discharged liquid is received by a receiving member. The liquid on the receiving member is removed by a remover. However, removing the discharged liquid every time the liquid discharges is a complex procedure.

SUMMARY OF THE INVENTION

According to a first aspect of the present invention, there is provided a liquid ejection apparatus including a head, a discharger, a receiving member, a remover, and a controller. The head includes a plurality of ejection openings for ejecting a liquid. The discharger is configured to discharge the liquid through at least one of the ejection openings. The receiving member is configured to receive the liquid discharged through at least one of the ejection openings. The remover is configured to remove the liquid on the receiving member. The controller is configured to: (a) control the head according to a recording command received to eject the liquid through the ejection openings toward a recording medium; (b) control the discharger to discharge the liquid toward the receiving member through at least one of the ejection openings; (c) determine whether a remaining amount representing an amount of the liquid on the receiving member and based at least on an amount of the liquid discharged onto the receiving member in the step (b) is equal to or greater than a first predetermined amount; and (d) control the remover to remove the liquid on the receiving member. The controller is configured to perform the step (a) before the step (d) when it is determined in the step (c) that the remaining amount is less than the first predetermined amount.

According to a second aspect of the present invention, there is provided a storage medium storing a program for causing a liquid ejection apparatus to execute a process. The liquid ejection apparatus includes a head, a discharger, a receiving member, and a remover. The head includes a plurality of ejection openings for ejecting a liquid. The discharger is configured to discharge the liquid through at least one of the ejection openings. The receiving member is configured to receive the liquid discharged through at least one of the ejection openings. The remover is configured to remove the liquid on the receiving member. The process includes the steps of: (a) controlling the head according to a recording command received to eject the liquid through the ejection openings toward a recording medium; (b) controlling the discharger to discharge the liquid toward the receiving member through at least one of the ejection openings; (c) determining whether a remaining amount representing an amount of the liquid on the receiving member and based at least on an amount of the liquid discharged onto the receiving member in the step (b) is equal to or greater than a first predetermined amount; and (d) controlling the remover to remove the liquid on the receiving member. The step (a) is performed before the step (d) when it is determined in the step (c) that the remaining amount is less than the first predetermined amount.

According to a third aspect of the present invention, there is provided a method of controlling a liquid ejection apparatus, the liquid ejection apparatus including a head, a discharger, a receiving member, and a remover. The head includes a plurality of ejection openings for ejecting a liquid. The discharger is configured to discharge the liquid through at least one of the ejection openings. The receiving member is configured to receive the liquid discharged through at least one of the ejection openings. The remover is configured to remove the liquid on the receiving member. The method includes the steps of: (a) controlling the head according to a recording command received to eject the liquid through the ejection openings toward a recording medium; (b) controlling the discharger to discharge the liquid toward the receiving member through at least one of the ejection openings; (c) determining whether a remaining amount representing an amount of the liquid on the receiving member and based at least on an amount of the liquid discharged onto the receiving member in the step (b) is equal to or greater than a first predetermined amount; and (d) controlling the remover to remove the liquid on the receiving member. The step (a) is performed before the step (d) when it is determined in the step (c) that the remaining amount is less than the first predetermined amount.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

An inkjet printer as an embodiment of the liquid ejection apparatus of the present invention is described below with reference to the accompanying drawings.

First Embodiment

Figure 1:
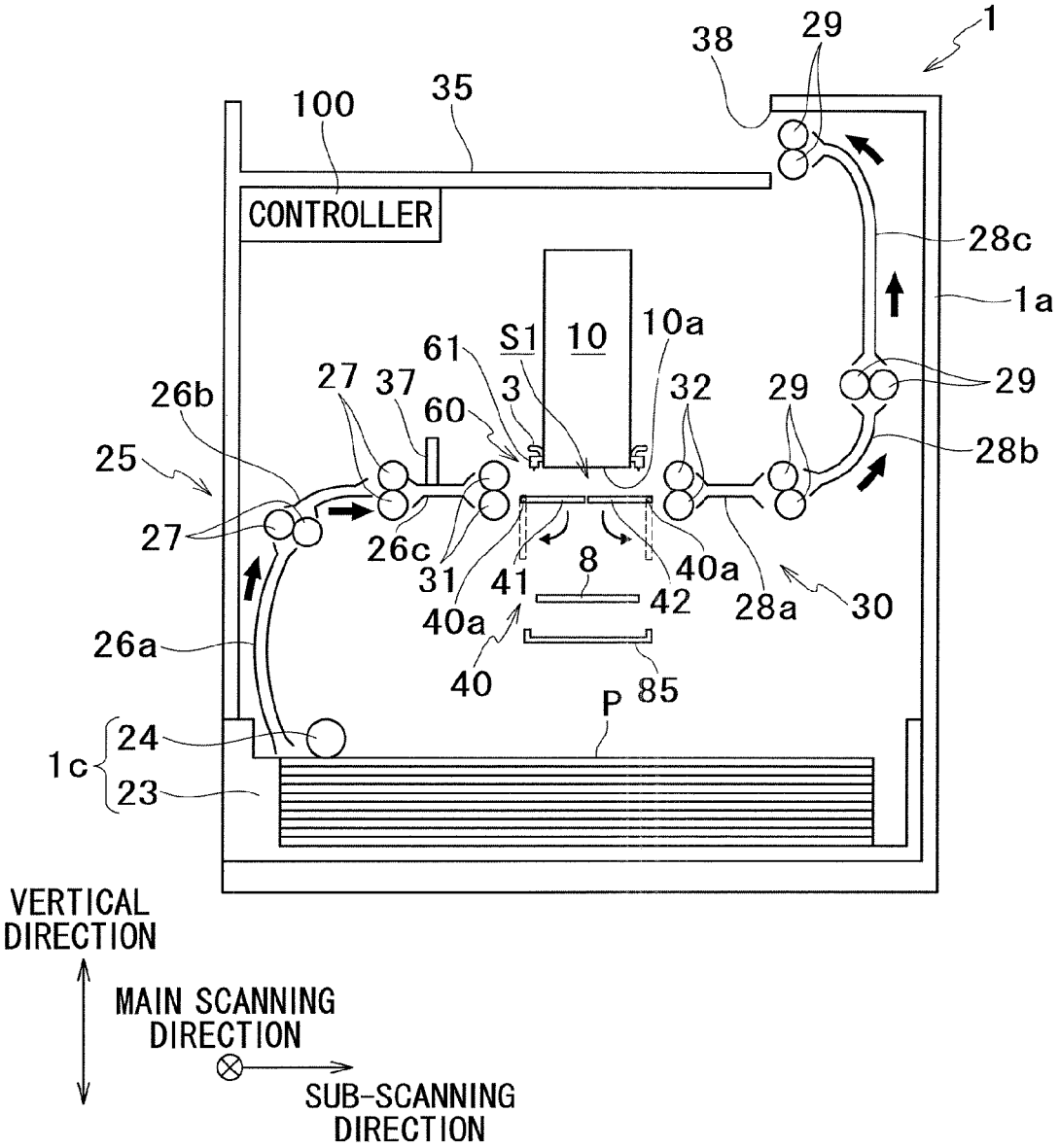
FIG. 1 is a schematic side view illustrating the overall configuration of an inkjet printer according to First Embodiment of the present invention.

Referring to FIG. 1, the overall configuration of an inkjet printer 1 according to First Embodiment of the present invention is described below. The printer 1 includes a cuboid-shaped housing 1*a*. A sheet discharge place 35 is provided at the top of the housing 1*a*. Inside the space defined by the housing 1*a* is formed a conveyance path of paper P (recording medium) extending from a sheet feeder 1*c* to the sheet discharge place 35, as indicated by thick arrows in FIG. 1.

The housing 1*a* accommodates an inkjet head 10, the sheet feeder 1*c*, a conveyor 30, a platen 40, a guide unit 25, a cartridge (not illustrated), a receiving member 8, a remover 55 (see FIGS. 3A and 3B), an elevator 96 (see FIG. 6), a sensor 51 (see FIG. 6), and a controller 100, among others. The platen 40 supports the paper P during a recording step. The cartridge stores a black ink supplied to the head 10, and is connected to the head 10 via a tube (not illustrated) and a pump 54 (see FIG. 6). The sensor 51 detects the temperature and humidity inside the housing 1*a*. The controller 100 controls the operation of each member in the printer 1.

The head 10 is a line head that ejects an ink through a plurality of ejection openings 108 (see FIG. 5B) in the state of being fixed at a predetermined position. The head 10 is substantially cuboid in shape, with the longer side along a main scanning direction. The lower surface of the head 10 represents an ejection surface 10*a* to which the ejection openings 108 open. For recording, a black ink is ejected through the ejection openings 108. The head 10 is supported on the housing 1*a* via a holder 3. The holder 3 holds the head 10 in a manner that forms a predetermined gap, suitable for recording, between the ejection surface 10*a* and the top surface of the platen 40. An annular member 61 forming a capping unit 60 is arranged around the head 10. The annular member 61 is attached to the holder 3, and surrounds the head 10 in planar view.

The conveyor 30 is configured to convey paper P passing through an opposing region S1 in a conveyance direction. The opposing region S1 is the region opposite the ejection surface 10*a*. The conveyor 30 includes nip rollers 31 and 32 positioned on the both sides of the platen 40 along the conveyance direction. The nip rollers 31 and 32 each include a pair of roller members positioned to face each other across the paper P, and apply a force to the paper P between the rollers, allowing it to be conveyed in the conveyance direction. The paper P under the applied force of the nip rollers 31 is conveyed in the conveyance direction as the top surface of the platen 40 provide support to the paper P. The paper P carried past the top surface of the platen 40 is subjected to the force applied by the nip rollers 32, and is conveyed toward the downstream side of the platen 40 in the conveyance direction.

The platen 40 includes a pair of door members 41 and 42, and a pair of rotating shafts 40*a*. The rotating shafts 40*a* extend in a direction parallel to the ejection surface 10*a*, and face each other across the ejection surface 10*a* in planar view. The door members 41 and 42 are supported by their respective rotating shafts 40*a* in a manner that enables the door members 41 and 42 to open and close. The platen 40 can selectively take an opposing position (see FIG. 2A) and a non-opposing position (see FIG. 2B) by the rotation about the rotating shafts 40*a* driven by a platen motor 43 (see FIG. 6). In the opposing position, the door members 41 and 42 are parallel to the horizontal plane, and face the ejection surface 10*a*. In the non-opposing position, the door members 41 and 42 hang down, and do not face the ejection surface 10*a*. The platen 40 takes the non-opposing position for maintenance, and the opposing position for recording. When the platen 40 is in the opposing position, the distance between the ejection surface 10*a* and the top surfaces of the door members 41 and 42 is smaller than the distance between the ejection surface 10*a* and the receiving member 8. The top surfaces of the door members 41 and 42, specifically the surfaces facing the ejection surface 10*a* are surfaces that support paper P, and materials used for these surfaces are treated or devised for better holding of the paper P.

The guide unit 25 includes an upstream guide unit and a downstream guide unit, positioned face to face across the conveyor 30. The upstream guide unit includes three guides 26*a*, 26*b*, and 26*c*, and two pairs of feed rollers 27. The upstream guide unit joins the sheet feeder 1*c* to the conveyor 30. The downstream guide unit includes three guides 28*a*, 28*b*, and 28*c*, and three pairs of feed rollers 29. The downstream guide unit joins the conveyor 30 to the sheet discharge place 35.

The sheet feeder 1*c* includes a sheet feeding tray 23 and a sheet feeding roller 24. The sheet feeding tray 23 is a box with an open top, capable of accommodating sheets of paper P. The sheet feeding roller 24 rotates under the control of the controller 100, and sends out the uppermost paper P in the sheet feeding tray 23. A sub scanning direction is a direction parallel to the conveyance direction of paper P by the conveyor 30, and is parallel to the horizontal direction in FIG. 1. The main scanning direction is the direction parallel to the horizontal plane and orthogonal to the sub scanning direction in FIG. 1.

The receiving member 8 is a rectangular plate member whose longer side and shorter side are along the main scanning direction and the sub scanning direction, respectively. The receiving member 8 is configured from hard material such as glass. The receiving member 8 in the main scanning direction and the sub scanning direction is one size larger than the ejection surface 10*a*. The receiving member 8 is configured to be capable of receiving all the ink discharged through the ejection openings 108 during the discharging step. The receiving member 8 is always positioned in the opposing region S1 opposite the ejection surface 10*a*, with the platen 40 positioned or not positioned between the ejection surface 10*a* and the receiving member 8. In this way, the combined projection area of the head 10 and the receiving member 8 is reduced as viewed from the top of the printer 1, making it possible to reduce the size of the printer 1.

Figure 3A:
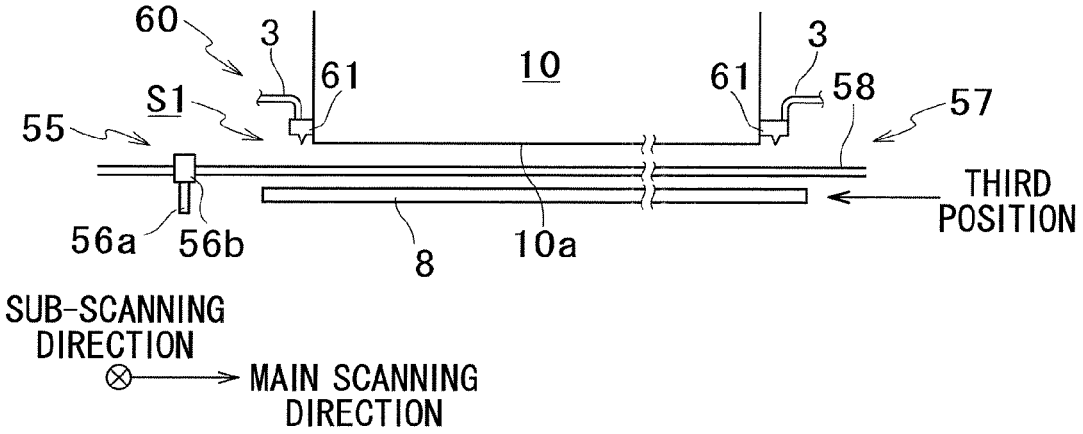
FIG. 3A is a diagram representing a state of the operations of a remover and the receiving member in a recording step.
Figure 3B:
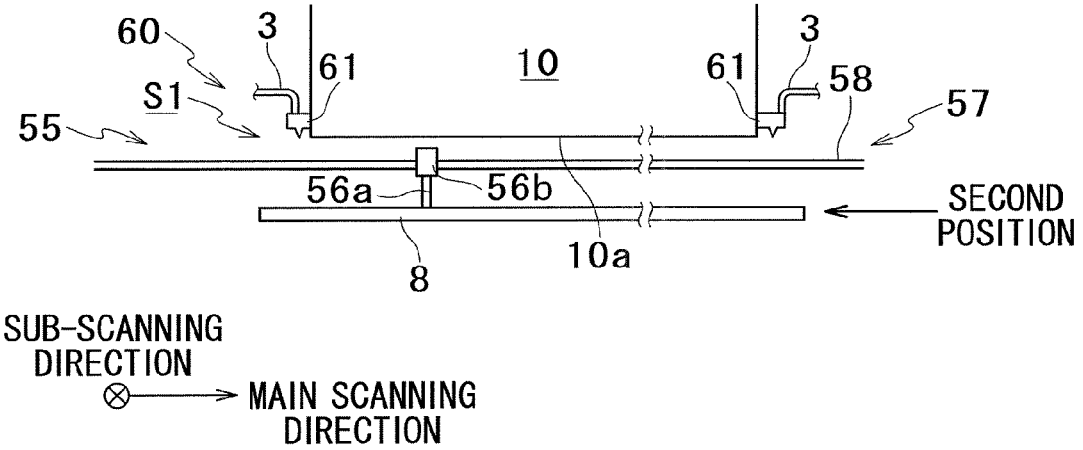
FIG. 3B is a diagram representing a state of the operations of the remover and the receiving member in a removing step.

As illustrated in FIGS. 3A and 3B, the remover 55 includes a wiper 56*a*, a base 56*b*, and a moving unit 57. The base 56*b* supports the wiper 56*a*. The wiper 56*a* is a plate-like member made of elastic material such as rubber. The wiper 56*a* is slightly longer than the receiving member 8 along the sub scanning direction. The moving unit 57 includes a guide 58 that extends along the main scanning direction, and a wiper motor 59 (see FIG. 6). The base 56*b* is connected to the wiper motor 59, and moves back and forth along the guide 58 by being driven by the wiper motor 59. In the removing step, the base 56*b* moves along the main scanning direction after the receiving member 8 has moved to a second position. In response, the wiper 56*a* moves relative to the receiving member 8 in contact therewith. As a result, the ink on the receiving member 8 is wiped and removed.

A waste liquid tray 85 is positioned beneath the receiving member 8, and is in communication with a waste liquid tank (not illustrated). The waste liquid tray 85 in the main scanning direction and the sub scanning direction is one size larger than the receiving member 8, and receives the ink dripped off from the receiving member 8 during the removing step.

Figure 2A:
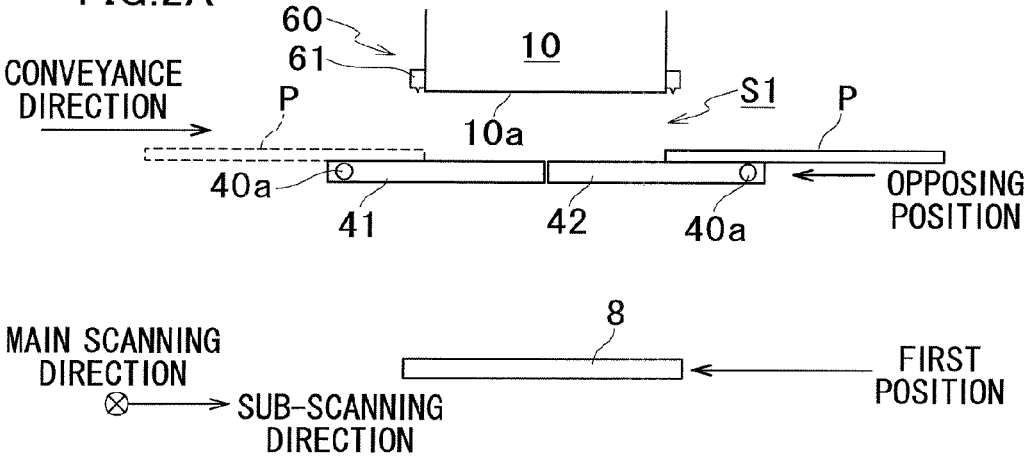
FIG. 2A is a diagram representing a state of the operations of a platen and a receiving member in a recording step.
Figure 2B:
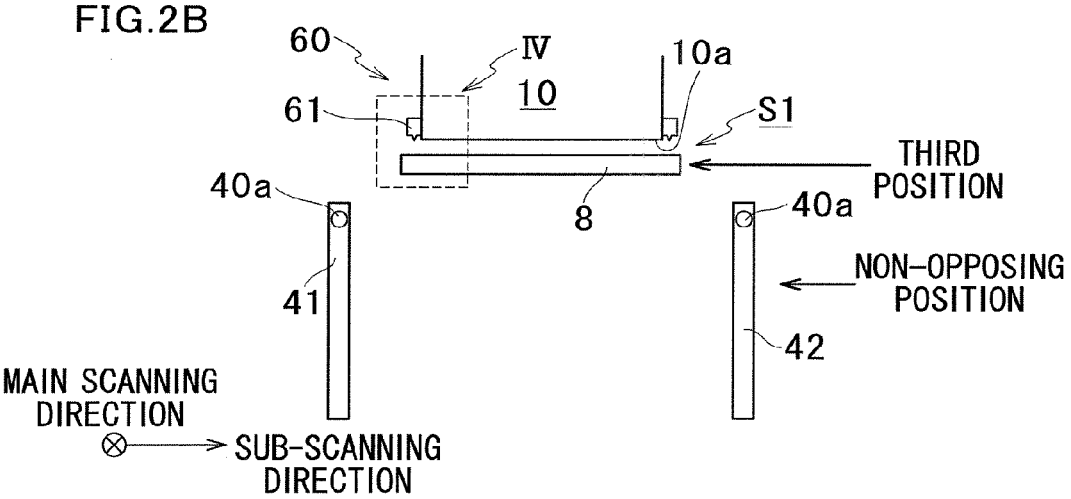
FIG. 2B is a diagram representing a state of the operations of the platen and the receiving member in a discharging step.
Figure 2C:
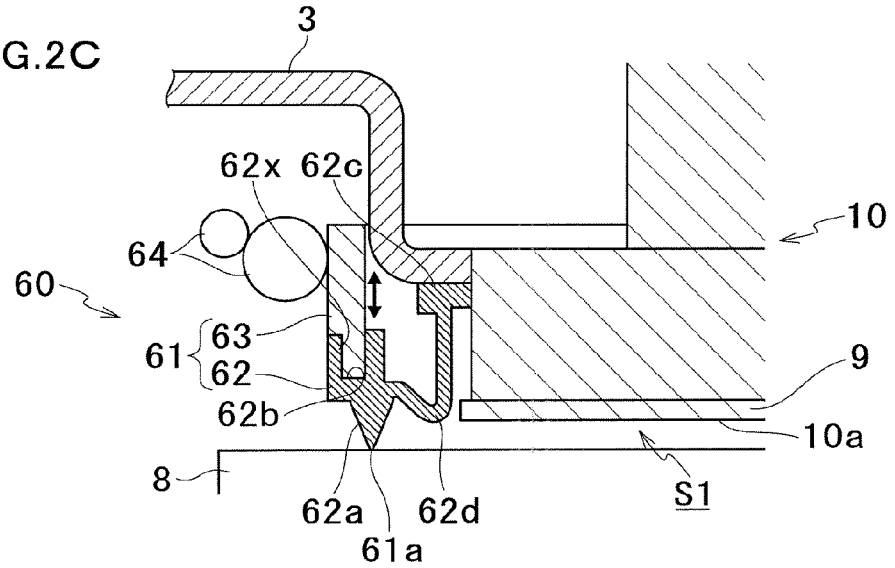
FIG. 2C is a partial cross sectional view of region VI surrounded by dashed lines in FIG. 2B.

The elevator 96 lifts the receiving member 8 up and down under the control of the controller 100. Specifically, the elevator 96 selectively moves the receiving member 8 to a first, a second, and a third position. As illustrated in FIG. 2A, the first position is the position of the receiving member 8 during the recording step. The second position, as illustrated in FIG. 3B, is the position above the first position, and is closer to the ejection surface 10*a* than the first position. The removing step takes place while the receiving member 8 is at the second position. Note that, while the receiving member 8 is at the second position, the wiper 56*a* and the base 56*b* are capable of moving between the head 10 and the receiving member 8 (see FIG. 3B). The third position, as illustrated in FIGS. 2B and 2C, is the position above the second position. Lifting down a movable body 63 of the annular member 61 while the receiving member 8 is at the third position brings a tip 61*a* of the annular member 61 into contact with the receiving member 8, and the annular member 61 and the receiving member 8 cap the ejection openings 108 (see FIG. 2C). The discharging step takes place while the receiving member 8 is at the third position.

The controller 100 is responsible for the overall operation of the printer 1 through the control of the operation of each member of the printer 1. For recording, the controller 100 receives a recording command from an external device (such as a PC connected to the printer 1) via an interface 50 (see FIG. 6). The recording step is the process for recording an image on paper P according to the recording command, and involves control of operations such as conveyance of paper P, and ejection of ink in synchronism with the conveyance of paper P. In the recording step, the paper P sent out from the sheet feeding tray 23 is guided through the guides 26*a*, 26*b*, and 26*c*, and sent to the conveyor 30 by being held between the pairs of feed rollers 27. The conveyor 30 sends the paper P into the opposing region (the region between the head 10 and the platen 40, opposite the ejection surface 10*a*) 51. Ink is sequentially ejected through the ejection openings 108 onto the paper P in the opposing region 51, and a monochromatic image is formed on the paper P. The ink ejection operation through the ejection openings 108 is performed under the control of the controller 100, using detection signals from a paper sensor 37. The paper P is then conveyed upward through the guides 28*a*, 28*b*, and 28*c* by being held between the pairs of feed rollers 29, and discharges to the sheet discharge place 35 through an opening 38 formed at the top of the housing 1*a*.

The controller 100 performs maintenance for maintaining or recovering the ink ejection performance of the head 10. The maintenance includes the discharging step, the removing step, and the capping step.

The discharging step is the process by which ink is discharged toward the receiving member 8 through at least one of the ejection openings. In the present embodiment, flushing corresponds to the discharging step of the present invention, and the actuator corresponds to the discharger of the present invention. As used herein, flushing means driving the actuator of the head 10 by using data irrelevant to recording, and forcibly ejecting the ink through a part of or all of the ejection openings 108.

The capping step means covering (capping) the ejection openings 108 with the annular member 61 and the receiving member 8, as illustrated in FIG. 2C. The capping step suppresses drying of the ink in the ejection openings 108. The capping step is performed, for example, while the printer 1 is shutoff or sleeping.

The removing step is the process by which the remover 55 is controlled to remove the ink on the receiving member 8. The removing step includes a first removing step and a second removing step. The first removing step is the process by which the remover 55 is controlled to make an ink amount on the receiving member 8 less than a first predetermined amount. The second removing step is the process by which the remover 55 is controlled to make the ink amount on the receiving member 8 less than a second predetermined amount smaller than the first predetermined amount. "First predetermined amount" is the least amount of the ink on the receiving member 8 that may cause spattering of the ink upon colliding of the discharged ink with the ink present on the receiving member 8, or cause the ink to overflow from the receiving member 8 in the discharging step. In other words, there is no spattering or overflow of the ink from the receiving member 8 in the discharging step when the ink amount on the receiving member 8 is below the first predetermined amount. "Second predetermined amount" is the least amount of the ink on the receiving member 8 that may greatly undermine effects such as the effect of the capping step suppressing drying of the ink in the ejection openings as the ink on the receiving member 8 adheres to the annular member 61 in large amounts upon the annular member 61 contacting the receiving member 8.

The head 10 is described below with reference to FIG. 4 and FIGS. 5A to 5C. In FIG. 5A, for convenience of explanation, a pressure chamber 110 and the ejection openings 108, provided beneath actuator units 21 and should be drawn in broken lines, are drawn in solid lines.

Figure 4:
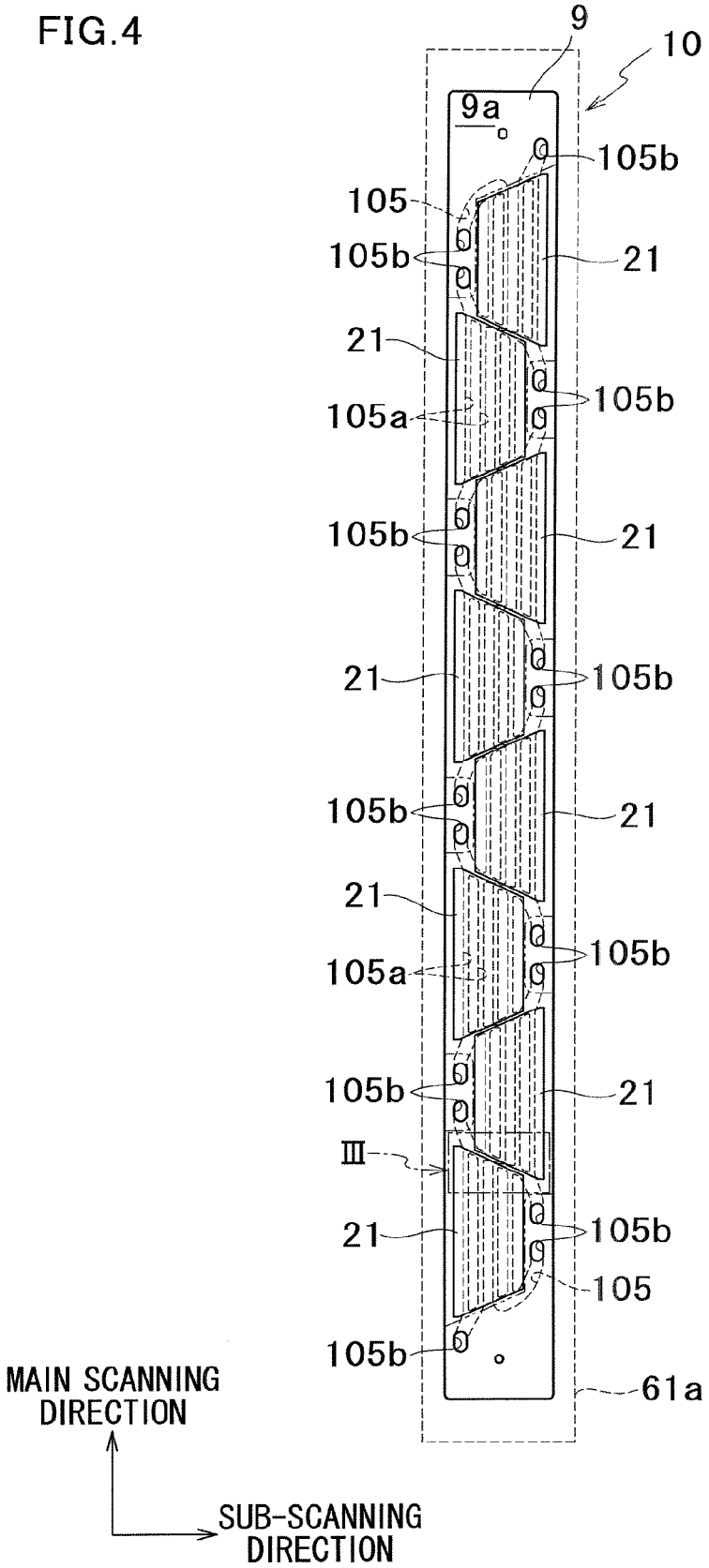
FIG. 4 is a plan view of an inkjet head contained in the printer of FIG. 1.
Figure 5A:
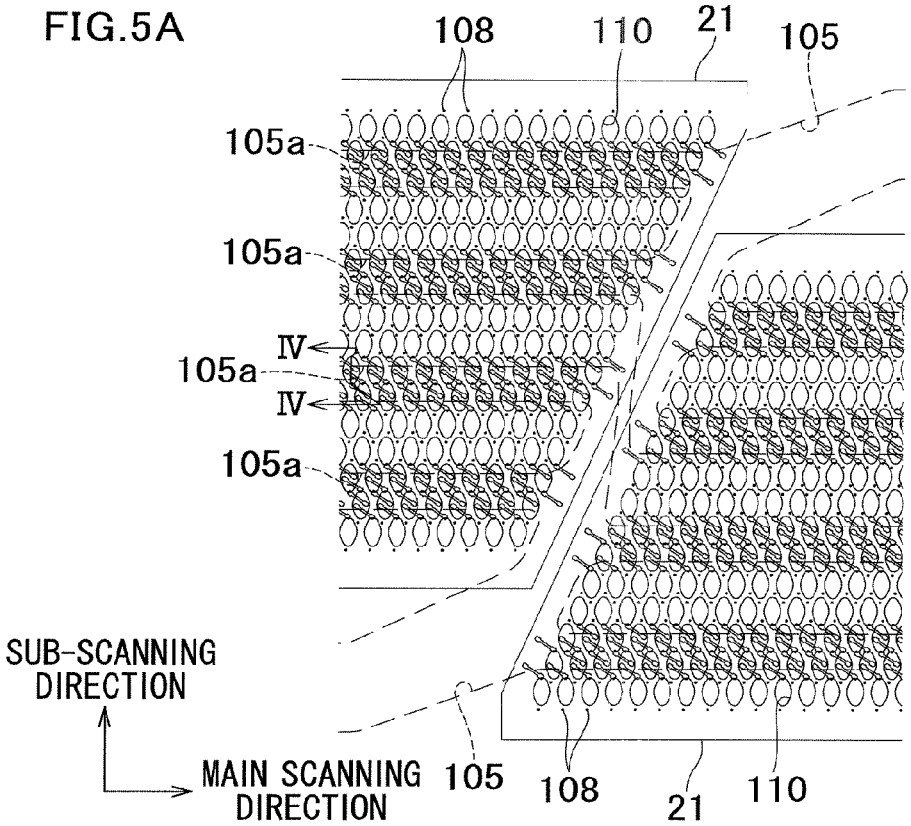
FIG. 5A is a magnified view of region III surrounded by dashed lines in FIG. 4.
Figure 5B:
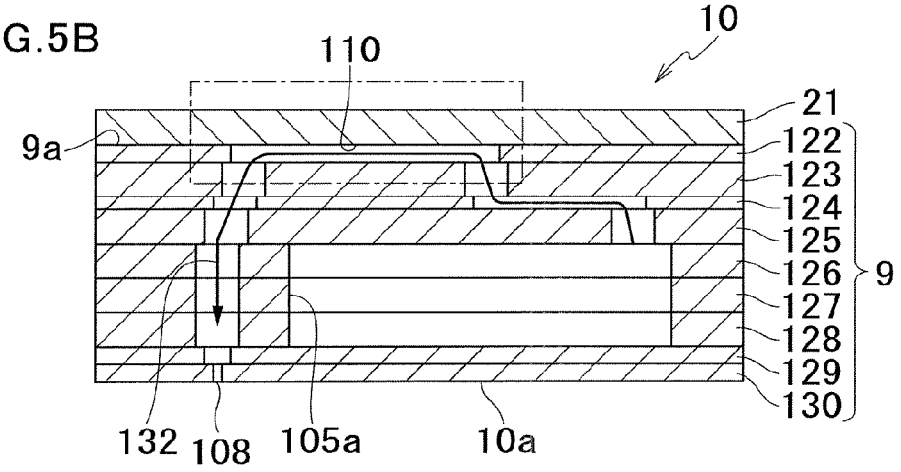
FIG. 5B is a partial cross sectional view taken at line IV-IV of FIG. 5A.

The head 10 is a laminate including a passage unit 9 and eight actuator units 21, as illustrated in FIG. 4. The pressure chamber 110 opens to a top surface 9*a* of the passage unit 9. The eight actuator units 21 are fixed to the top surface 9*a*, and, as illustrated in FIG. 5B, form the side walls of the pressure chamber 110 by sealing the opening of the pressure chamber 110. As illustrated in FIG. 5B, the passage unit 9 is a laminate of nine stainless-steel plates 122 to 130. Ink passages are formed inside the passage unit 9. The ink passages include a manifold passage 105, sub-manifold passages 105*a*, and individual passages. The manifold passage 105 extends from ink supply openings 105*b* at the top surface 9*a*. The sub-manifold passages 105*a* branches out from the manifold passage 105. The individual passages lead to the ejection openings 108 on the bottom surface from the outlets of the sub-manifold passages 105*a* via the pressure chamber 110.

Figure 5C:
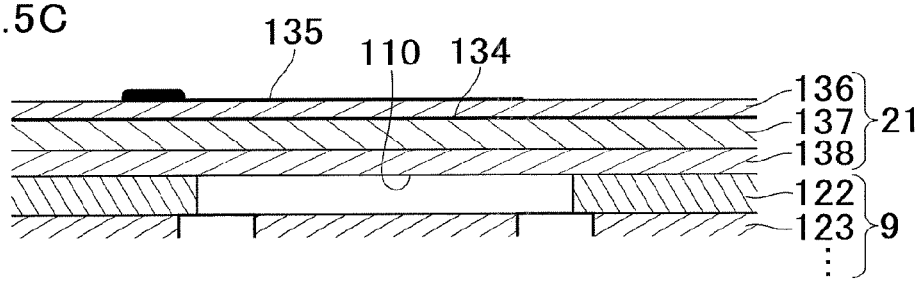
FIG. 5C is a magnified view of the region surrounded by dashed-dotted lines in FIG. 5B.

The actuator units 21 are described below. As illustrated in FIG. 4, the eight actuator units 21 are adjacent to one another in the main scanning direction. Each actuator unit 21 has a trapezoidal planar shape, and is positioned to circumvent the ink supply openings 105*b*. The actuator units 21 each include three piezoelectric layers 136 to 138, as illustrated in FIG. 5C. The piezoelectric layers 136 to 138 are configured from a ferroelectric lead zirconate titanate (PZT) ceramic. The piezoelectric layer 136 representing the uppermost layer has individual electrodes 135 formed on the top surface, and is polarized in thickness direction. The portion sandwiched between the individual electrodes 135 and the pressure chamber 110 serves as an individual unimorph actuator. In the presence of an electric field in the direction of polarization between the individual electrodes 135 and a common electrode 134, the actuator projects out toward the pressure chamber 110 (unimorph deformation). Here, pressure is exerted to the ink inside the pressure chamber 110, and the ink is ejected through the ejection openings 108. The common electrode 134 is held at ground potential at all times. The drive signals are selectively supplied to the individual electrodes 135.

The present embodiment employs the pull-and-propel method to eject ink. The individual electrodes 135 are at the predetermined potential, and the actuator is under unimorph deformation. Under supplied drive signals, the individual electrodes 135 are temporality brought to the same potential as the common electrode 134, and return to the predetermined potential after a predetermined time period. The actuator is released from the unimorph deformation at the timing when the individual electrodes 135 are brought to the same potential as the common electrode 134, and the ink is sucked into the pressure chamber 110. The actuator undergoes unimorph deformation again at the timing when the individual electrodes 135 return to the predetermined potential, and the ink is ejected through the ejection openings 108.

The configurations of the holder 3 and the capping unit 60 are described below, with reference to FIGS. 2C and 4. The holder 3 is a frame made of material such as metal, supporting the side surfaces of the head 10 over the whole periphery. The annular member 61 is attached to the holder 3.

Figure 6:
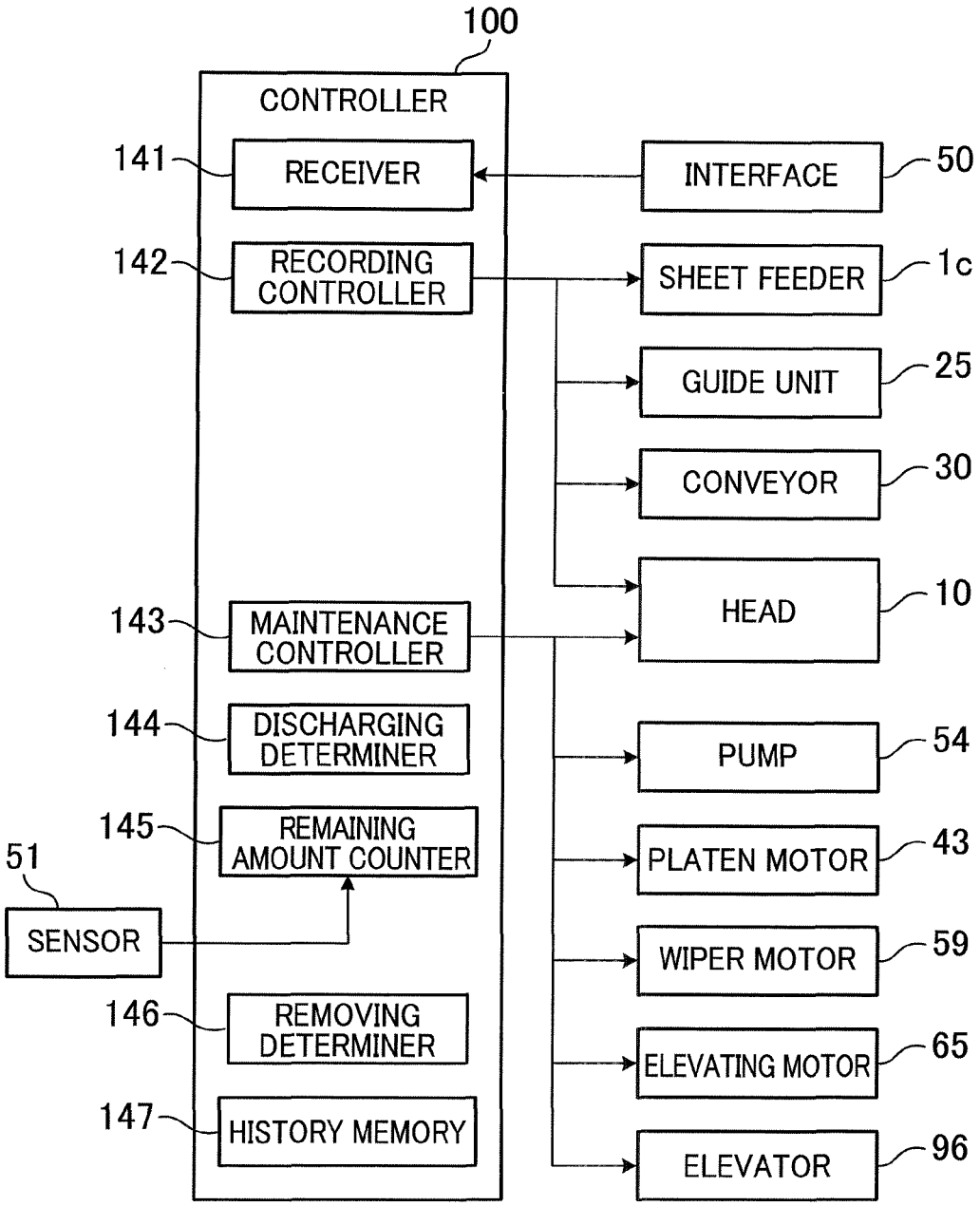
FIG. 6 is a block diagram representing the electrical configuration of the controller shown in FIG. 1.

The capping unit 60 includes the annular member 61, gears 64, and an elevating motor 65 (see FIG. 6). The annular member 61 includes an elastic body 62 and the movable body 63. The elastic body 62 is made of elastic material such as rubber, and is annular in shape, surrounding the head 10 in planar view. As illustrated in FIG. 2C, the elastic body 62 includes a base 62*x*, a protrusion 62*a*, a fixed portion 62*c*, and a connector 62*d*. The protrusion 62*a* has a triangular cross section, and projects out of the bottom surface of the base 62*x*. The fixed portion 62*c* has a T-shaped cross section. The top of the fixed portion 62*c* is fixed to the holder 3 with an adhesive or the like. The connector 62*d* is provided to connect the base 62*x* to the fixed portion 62*c*. Specifically, the connector 62*d* curves outwardly from the bottom end of the fixed portion 62*c* (in a direction away from the ejection surface 10*a* in planar view), and connects itself to the side surface at the bottom of the base 62*x*. The connector 62*d* deforms as the movable body 63 moves up and down. A depression 62*b* is formed in the top surface of the base 62*x*. The bottom end of the movable body 63 interdigitates with the depression 62*b*.

The movable body 63 is made of rigid material such as stainless steel, and is annular in shape, surrounding the head 10 in planar view. The movable body 63 is supported by the elastic body 62, and is movable in the vertical direction relative to the holder 3. The movable body 63 is connected to the gears 64. Driving the elevating motor 65 (see FIG. 6) under the control of the controller 100 rotates the gears 64 and moves the movable body 63 up and down. Here, the base 62*x* moves with the movable body 63. This causes a change in the relative positions of the tip 61*a* and the ejection surface 10*a* in the vertical direction. When the receiving member 8 is at the third position (see FIG. 2), the protrusion 62*a* selectively takes a contact position (the tip 61*a* is in contact with the receiving member 8; see FIG. 2C), or a separate position (the tip 61*a* is separated from the receiving member 8; see FIG. 2B) as the movable body 63 moves up and down.

The controller 100 is described below in greater detail with reference to FIG. 6. The controller 100 includes a CPU (Central Processing Unit), a ROM (Read Only Memory) for rewritably storing control programs executed by the CPU, and data used by the control programs, and a RAM (Random Access Memory) for temporarily storing data during the execution of the control programs. The functional units forming the controller 100 are constructed from the hardware in cooperation with the software in the ROM. As represented in FIG. 6, the functional units of the controller 100 include a receiver 141, a recording controller 142, a maintenance controller 143, a discharging determiner 144, a remaining amount counter 145, a removing determiner 146, and a history memory 147.

The receiver 141 receives a recording command from an external device via the interface 50. The recording command includes image data to be recorded in at least a single sheet of paper P.

The recording controller 142 performs the recording step. Specifically, the recording controller 142 controls the sheet feeder 1*c* and the conveyor 30 according to the recording command to convey paper P along the conveyance direction at a predetermined speed. The recording controller 142 also controls the actuator of the head 10 according to the image data contained in the recording command, causing the ink to be ejected toward the paper P positioned in the opposing region 51. Here, the distance between the continuously conveyed sheets of paper P during a continuous recording is greater than the length of the conveyance direction (sub scanning direction) on the ejection surface 10*a*. Accordingly, more than one sheet of paper P will not be simultaneously positioned in the opposing region 51. As used herein, "continuous recording" means that the recording controller 142 continuously performs the recording step for a plurality of sheets of paper P, and includes a recording step for a plurality of sheets of paper P based on a single recording command, and a continuous recording step performed according to a plurality of recording commands.

For various maintenance procedures, the maintenance controller 143 appropriately controls the actuator of the head 10, the pump 54, the platen motor 43, the wiper motor 59, the elevating motor 65, and the elevator 96.

The discharging determiner 144 determines whether the discharging step needs to be performed in each intermediate period of a continuous recording. The "intermediate period"

is a time period from a time point when an upstream end of paper P with respect to the conveyance direction passes the opposing region S1 (solid lines in FIG. 2A) to a time point when a downstream end of the next sheet of paper P with respect to the conveyance direction reaches the opposing region S1 (dotted lines in FIG. 2A). In other words, the "intermediate period" is a time period in which paper P is not positioned in the opposing region in a continuous recording. When any of the ejection openings 108 has not ejected ink for duration equal to or longer than a predetermined time period (no ejection period) during a continuous recording, the discharging determiner 144 determines that such ejection openings 108 need to discharge ink and require the discharging step. In the discharging step, only the ejection openings 108 with the no ejection period equal to or longer than the predetermined time period eject ink.

The remaining amount counter 145 calculates the remaining amount of the ink on the receiving member 8. Specifically, the remaining amount counter 145 first calculates an assumed remaining amount from information such as the contents of the previous discharging steps stored in the history memory 147 (including discharged ink amounts, and the time when discharging steps were performed), and the contents of the previous removing steps (including the number of times the wiper 56*a* has moved relative to the receiving member 8, and the time when removing steps were performed). "Assumed remaining amount" does not take into account a "dry amount", the amount of the ink that dries over time on the receiving member 8. The remaining amount counter 145 then calculates a "dry amount" from the current results of the temperature and humidity detected by the sensor 51 after each discharging step. The remaining amount counter 145 calculates "remaining amount" by subtracting the "dry amount" from the "assumed remaining amount". As a variation, the remaining amount counter 145 may find the remaining amount by acquiring the current ink amount on the receiving member 8 through actual measurement using a sensor. In the present embodiment, the "remaining amount" means an amount of the ink present on the receiving member 8 at the time of calculation.

The overall throughput of the printer 1 lowers when the removing step is always performed after the discharging step in the intermediate period. In the present embodiment, instead of always performing the removing step after the discharging step in the intermediate period, the removing determiner 146 determines whether the removing step should be performed after the discharging step, and the removing step is performed only when the removing determiner 146 determined that the removing step should be performed. The removing determiner 146 determines that the removing step should be performed when the remaining amount is equal to or greater than the first predetermined amount, and that the removing step should not be performed when the remaining amount is less than the first predetermined amount. This makes it possible to suppress lowering of the overall throughput of the printer 1, and to prevent spattering or overflow of the ink from the receiving member 8 in the next discharging step.

The history memory 147 stores the contents of the discharging step and the removing step previously performed by the maintenance controller 143.

Figure 7:
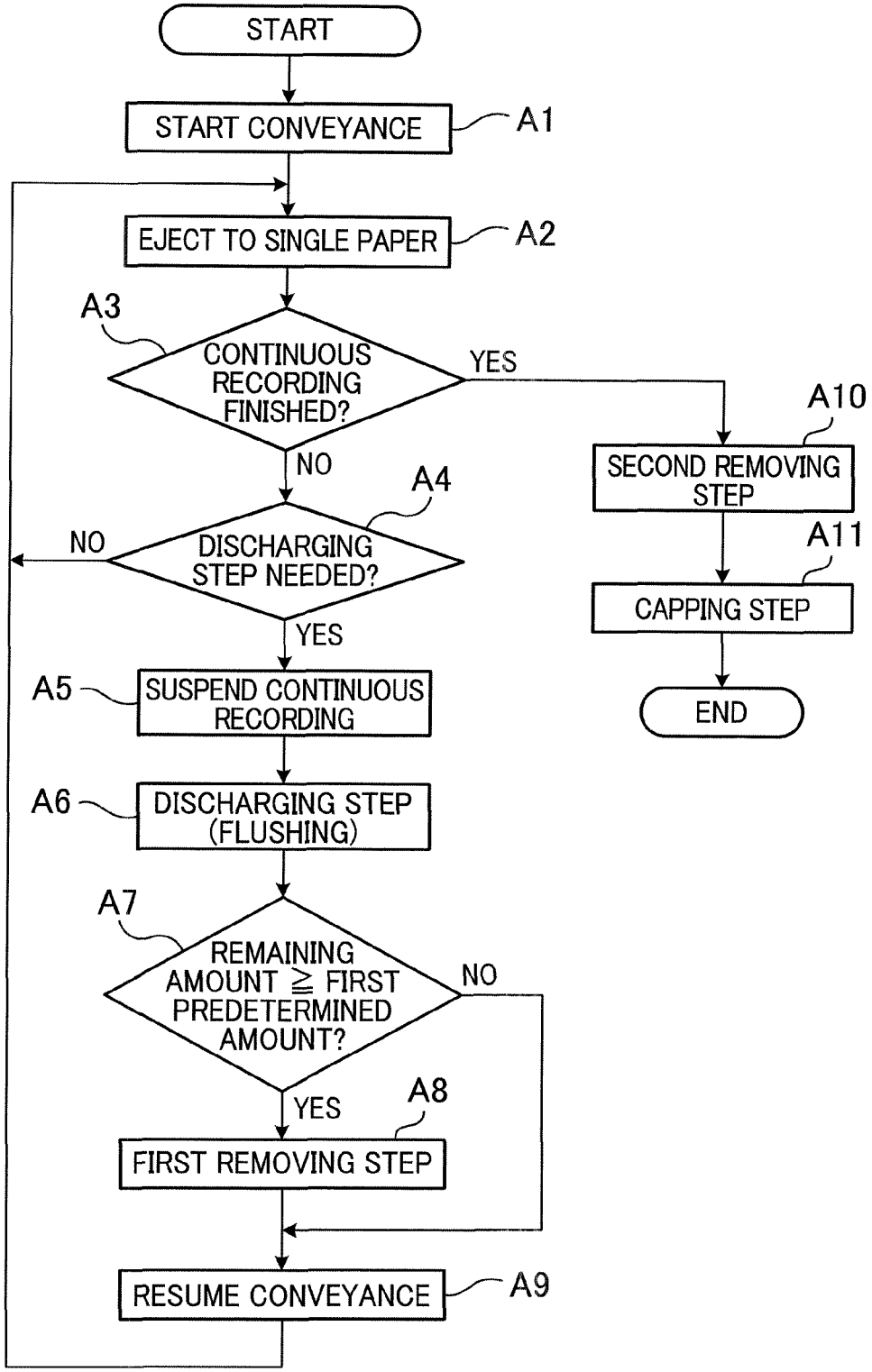
FIG. 7 is a flowchart representing a process executed by the controller shown in FIG. 1.

Maintenance during a continuous recording is described below with reference to FIG. 7. The flow represented in FIG. 7 begins, for example, upon the receiver 141 receiving one or more recording commands for the continuous recording of 100 sheets of paper P. At the start of the flow represented in FIG. 7, the receiving member 8 and the platen 40 are in the first position and the opposing position, respectively, and the ink amount on the receiving member 8 is less than the second predetermined amount.

For the continuous recording based on the recording command(s) received by the receiver 141, the recording controller 142 first controls the sheet feeder 1*c*, the guide unit 25, and the conveyor 30, and sequentially sends out a plurality of sheets of paper P from the sheet feeding tray 23 toward the opposing region S1 (A1). Then, the recording controller 142 controls the head 10, and the head 10 ejects ink through the ejection openings toward a single sheet of paper P fed to the opposing region S1 (A2). As a result, an image is recorded in the paper P.

After A2, the recording controller 142 determines whether the continuous recording has finished (A3). When it is determined by the recording controller 142 that the continuous recording has not been finished (A3: NO), the discharging determiner 144 determines whether the discharge step needs to be performed in the intermediate period defining a time period from a time point when the upstream end of the paper P with respect to the conveyance direction passes the opposing region S1 with the ejected ink (A2) to a time point when the downstream end of the paper P with respect to the conveyance direction subject to the next ink ejection reaches the opposing region S1 (A4). When it is determined by discharging determiner 144 that the discharging step is not necessary, the process returns to A2, and the continuous recording proceeds (A4: NO).

When it is determined by discharging determiner 144 that the discharging step is necessary (A4: YES), the recording controller 142 controls the sheet feeder 1*c*, the guide unit 25, and the conveyor 30, and suspends the conveyance of the paper P (A5). After A5, the maintenance controller 143 controls the platen motor 43 and the elevator 96, and moves the platen 40 to the non-opposing position, and the receiving member 8 to the third position. For flushing, the maintenance controller 143 then controls the actuator of the head 10, and causes the receiving member 8 to discharge ink only through the ejection openings 108 in which the no ejection period is equal to or greater than the predetermined time period (A6). Then, the removing determiner 146 determines whether the remaining amount calculated by the remaining amount counter 145 is equal to or greater than the first predetermined amount (A7). When the remaining amount is less than the first predetermined amount (A7: NO), the removing determiner 146 determines that the removing step should not be performed. In this case, the maintenance controller 143 controls the platen motor 43 and the elevator 96, and moves the platen 40 to the opposing position, and the receiving member 8 to the first position. The process then goes to A9.

When the remaining amount is equal to or greater than the first predetermined amount (A7: YES), the removing determiner 146 determines that the removing step should be performed. In this case, the maintenance controller 143 controls the elevator 96, and moves the receiving member 8 to the second position. The maintenance controller 143 then controls the wiper motor 59, and the first removing step is performed (A8). In A8, the wiper 56*a* is moved relative to the receiving member 8 in numbers necessary to make the ink amount on the receiving member 8 less than the first predetermined amount. After A8, the maintenance controller 143 controls the platen motor 43 and the elevator 96, and moves the platen 40 to the opposing position, and the receiving member 8 to the first position. The process then goes to A9.

In A9, the recording controller 142 controls the sheet feeder 1*c*, the guide unit 25, and the conveyor 30 to resume the conveyance of the paper P to the opposing region S1. After A9, the recording controller 142 returns the process to A2.

When it is determined by the recording controller 142 that the continuous recording has finished (A3: NO), the maintenance controller 143 controls the platen motor 43 and the elevator 96, and moves the platen 40 to the non-opposing position, and the receiving member 8 to the second position. The maintenance controller 143 then controls the wiper motor 59, and performs the second removing step (A10). In A10, the wiper 56*a* is moved relative to the receiving member 8 in numbers necessary to make the ink amount on the receiving member 8 less than the second predetermined amount. The second removing step enables the ink amount on the receiving member 8 to be reduced for the capping step, and adhesion of the ink to the annular member 61 to be suppressed. It is also possible to reduce the ink amount on the receiving member 8 for the next continuous recording.

After A10, the maintenance controller 143 controls the elevator 96, and moves the receiving member 8 to the third position in preparation for the capping step. The maintenance controller 143 then controls the elevating motor 65 to lower the movable body 63 and bring the tip 61*a* into contact with the receiving member 8 (A11). This makes it possible to suppress the viscosity increase caused by evaporation of the ink inside the ejection openings 108. The routine ends after A11.

In the present embodiment, the recording step (A9, A2) is performed before the removing step (A8) when the remaining amount is less than the first predetermined amount (A7: NO), instead of performing the removing step every time the discharging step (A6) is performed. This makes it possible to make the procedure less complex.

Further, in the present embodiment, the discharge of the ink through the ejection openings 108 in the discharging step (A6) is followed by the first removing step (A8) when the remaining amount is equal to or greater than the first predetermined amount. In this way, it is possible to prevent contamination caused inside the printer 1 by the ink discharged through the ejection openings 108 in the discharging step performed in A8 and the subsequent steps. Further, because the removing step (A8) is not performed when the remaining amount is less than the first predetermined amount (A7: NO), the omission of the unnecessary removing steps makes it possible to suppress lowering of the overall throughput of the printer 1.

The removing step can involve factors that are detrimental to recording (vibration, power supply current fluctuations, and the like), as compared to when the removing step is not performed. In the present embodiment, the recording step is not performed while the removing step is performed. This makes it possible to improve the quality of the image recorded on paper P.

It should be noted that, structurally, the printer 1 cannot execute the recording step and the removing step simultaneously. This is because the wiper 56*a* and the base 56*b* are positioned in the opposing region S1 during the removing step, as illustrated in FIG. 3B.

The remaining amount counter 145 calculates the remaining amount taking into account the dry amount. In this case, the remaining amount is less likely to be determined as being equal to or greater than the first predetermined amount in the process of A7, as compared to when the remaining amount counter 145 calculates the remaining amount without taking into account the dry amount. It may be possible in this case to perform the removing step less often during a continuous recording.

Second Embodiment

Second Embodiment of the present invention is described below with reference to FIGS. 8 and 9. Second Embodiment mainly differs from First Embodiment in that the determination as to whether the remaining amount is equal to or greater than the first predetermined amount is made before the discharging step in the intermediate period for which the discharging step was determined as being necessary, and that the first removing step is performed when the remaining amount is determined as being equal to or greater than the first predetermined amount, and the discharging step is performed thereafter. Another difference is the technique used to calculate the remaining amount. In the present embodiment, a purge corresponds to the discharging step of the present invention, and the pump 54 (see FIG. 6) corresponds to the discharger of the present invention. As used herein, "purge" means exerting pressure to the ink inside the head 10 using the pump 54, and forcibly discharging the ink from all of the ejection openings 108. In the following, the elements already described in First Embodiment are given the same reference numerals, and explanations thereof are omitted as appropriate.

Figure 8:
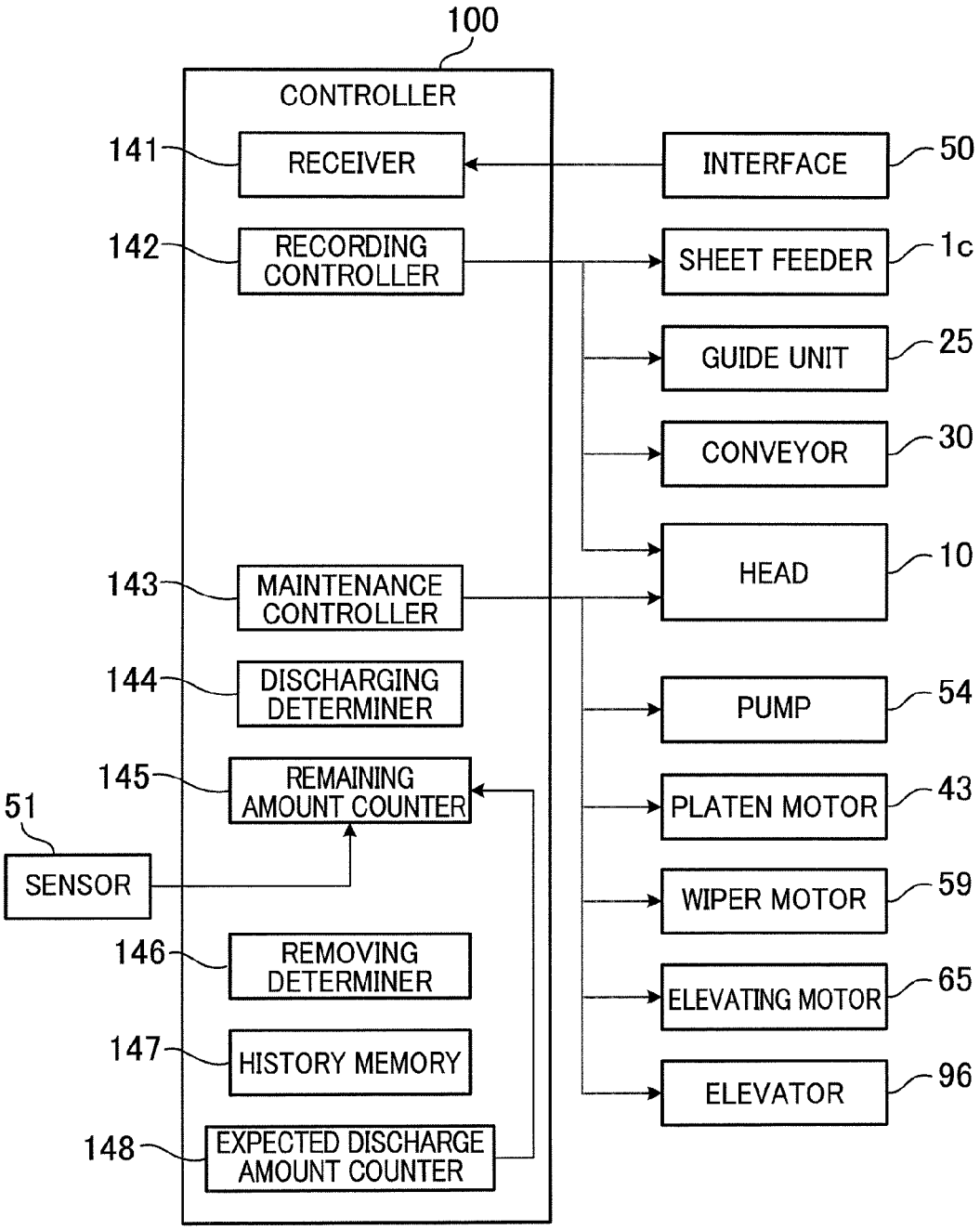
FIG. 8 is a block diagram representing the electrical configuration of the controller contained in an inkjet printer according to Second Embodiment of the present invention.
Figure 9:
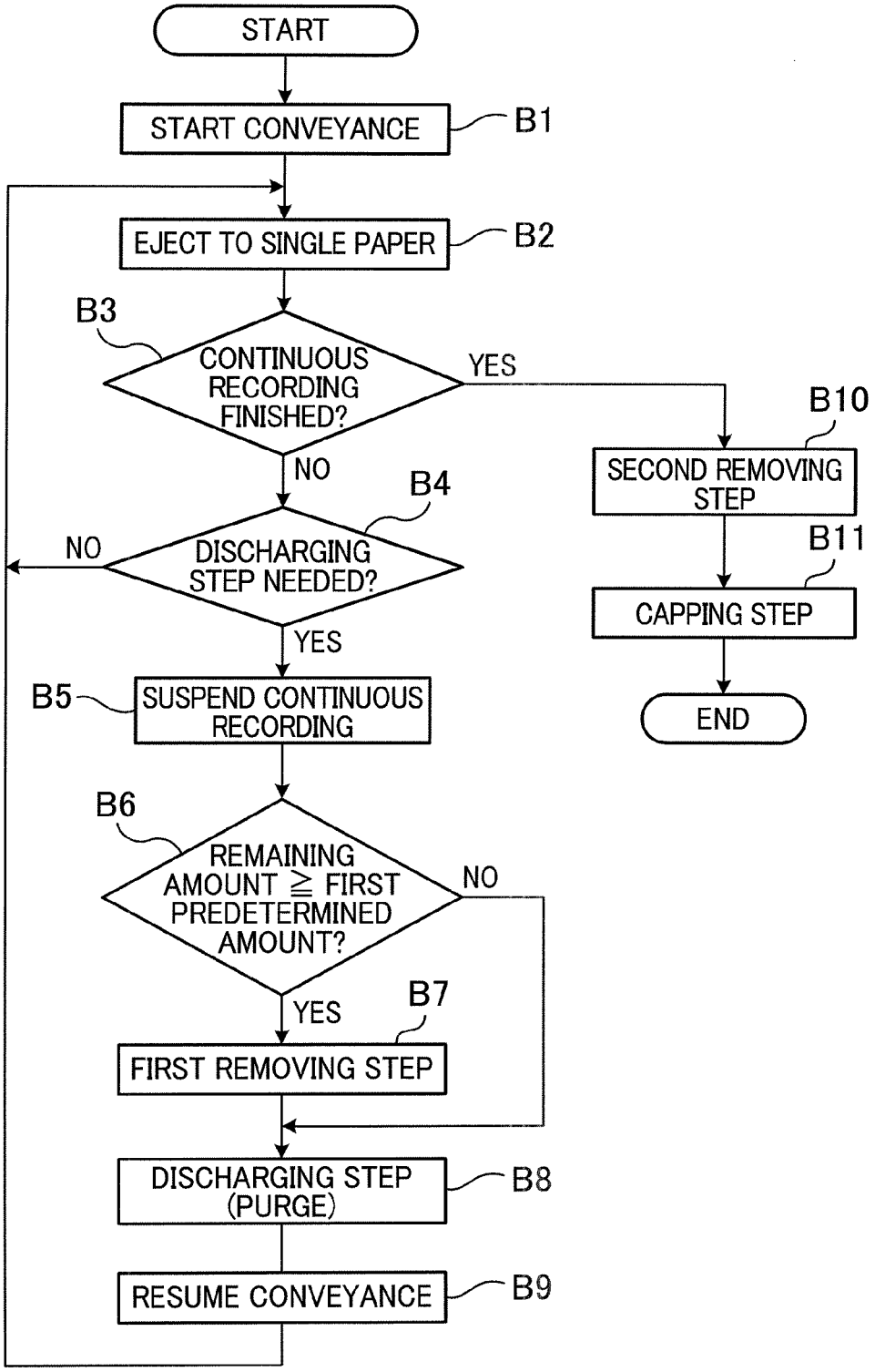
FIG. 9 is a flowchart representing a process executed by the controller shown in FIG. 8.

In the present embodiment, the functional units of the controller 100 include an expected discharge amount counter 148, in addition to the receiver 141, the recording controller 142, the maintenance controller 143, the discharging determiner 144, the remaining amount counter 145, the removing determiner 146, and the history memory 147, as represented in FIG. 8.

In the present embodiment, the discharging determiner 144 determines that the discharging step is needed for an intermediate period that occurs first after an elapsed time period equal to or greater than a predetermined time period from the previous discharging step, and that the discharging step is not necessary for other intermediate periods. As a variation, the discharging determiner 144 may determine that the discharging step is needed for an intermediate period that occurs first after the number of papers P with the recorded image formed by the recording controller 142 reaches the predetermined number, provided that the distance between the papers P, and the conveyance speed of the papers P in the continuous conveyance are constant.

The expected discharge amount counter 148 calculates the "expected discharge amount." As used herein, "expected discharge amount" is the expected amount of the ink to be discharged in the upcoming discharging step.

In the present embodiment, the remaining amount counter 145 first calculates the assumed remaining amount and the dry amount as in First Embodiment, and finds the remaining amount by adding (i) the amount obtained by subtracting the dry amount from the assumed remaining amount, and (ii) the expected discharge amount calculated by the expected discharge amount counter 148. Specifically, the remaining amount as used in the present embodiment means the sum amount of the ink present on the receiving member 8 at the time of calculation, and the ink amount to be discharged onto the receiving member 8 in the upcoming discharging step.

Maintenance during a continuous recording according to the present embodiment is described below with reference to FIG. 9. The flow represented in FIG. 9 starts under the same conditions as in the flow of FIG. 7.

The procedure begins with processes B1 to B5, corresponding to A1 to A5 of First Embodiment. After B5, the removing determiner 146 determines whether the remaining amount calculated by the remaining amount counter 145 is equal to or greater than the first predetermined amount (B6). When it is determined that the remaining amount is less than the first predetermined amount (B6: NO), the removing determiner 146 determines that the removing step should not be performed. In this case, the maintenance controller 143 controls the platen motor 43 and the elevator 96, and moves the platen 40 to the non-opposing position, and the receiving member 8 to the third position. The process then goes to B8. When the remaining amount is equal to or greater than the first predetermined amount (B6: YES), the removing determiner 146 determines that the removing step should be performed. The process then goes to B7.

In B7, the maintenance controller 143 first controls the platen motor 43 and the elevator 96, and moves the platen 40 to the non-opposing position, and the receiving member 8 to the second position. The maintenance controller 143 then controls the wiper motor 59, and the first removing step is performed. In B7, the wiper 56*a* is moved relative to the receiving member 8 in numbers necessary to make the ink amount on the receiving member 8 less than the first predetermined amount. After B7, the maintenance controller 143 controls the elevator 96, and moves the receiving member 8 to the first position. The process then goes to B8.

In B8, the maintenance controller 143 controls the pump 54 for purging, discharging the ink onto the receiving member 8 through all the ejection openings 108. After B8, the maintenance controller 143 controls the platen motor 43 and the elevator 96, and moves the platen 40 to the non-opposing position, and the receiving member 8 to the first position. Then, the recording controller 142 controls the sheet feeder 1*c*, the guide unit 25, and the conveyor 30 to resume the conveyance of paper P to the opposing region S1 (B9). After B9, the recording controller 142 returns the process to B2.

When it is determined by the recording controller 142 that the continuous recording has finished (B3: NO), the maintenance controller 143 controls the platen motor 43 and the elevator 96, and moves the platen 40 to the non-opposing position, and the receiving member 8 to the second position. Then, the maintenance controller 143 controls the wiper motor 59, and the second removing step is performed (B10). The second removing step (B10) is performed longer than the first removing step (B7). This makes it possible to reduce the ink amount on the receiving member 8 for the capping step, and suppress adhesion of the ink to the annular member 61. It is also possible to reduce the ink amount on the receiving member 8 for the next continuous recording. After B10, the maintenance controller 143 performs the capping step (B11), as in A11. The routine ends after B11.

In the present embodiment, the recording step (B9, B2) is performed before the removing step (B7) when the remaining amount is less than the first predetermined amount (B6: NO), instead of performing the removing step every time the discharging step (B8) is performed. This makes it possible to make the procedure less complex.

Further, in the present embodiment, the determination as to whether the remaining amount is equal to or greater than the first predetermined amount (B6) is made before the ink discharges through the ejection openings 108 in the discharging step (B8), and the first removing step (B7) is performed when the remaining amount is equal to or greater than the first predetermined amount (B6: YES). In this way, it is possible to prevent contamination caused inside the printer 1 by the ink discharged through the ejection openings 108 in the discharging step (B8). Further, because the removing step (B7) is not performed when the remaining amount is less than the first predetermined amount (B6: NO), the omission of the unnecessary removing steps makes it possible to suppress lowering of the overall throughput of the printer 1.

Another thing to note is that the purge in the present embodiment corresponds to the discharging step. The discharging determiner 144 determines that the discharging step is needed for an intermediate period that occurs first after a time period equal to or longer than the predetermined time period from the previous discharging step. This makes it possible for the discharging determiner 144 to more easily determine whether the discharging step is needed.

Third Embodiment

Third Embodiment of the present invention is described below with reference to FIGS. 10 to 12. The following descriptions deal with only the differences from First Embodiment. The elements already described in First Embodiment are given the same reference numerals, and explanations thereof are omitted as appropriate.

In the present embodiment, the discharging step is performed after the recording step is finished (see C2, C3; C10, C11; C15, C16), for purposes such as removing a paper powder adhered to the ejection openings 108 during the recording step, and discharging the dried and thickened ink through the ejection openings 108 of long no ejection periods in the recording step. In the present embodiment, "flushing" corresponds to the discharging step of the present invention, and the actuator corresponds to the discharger of the present invention. The discharging step following the completion of the recording step is performed before the removing step (C5, C12) performed first after the recording step is finished. As a variation, the removing step may be performed before the discharging step when the amount of the ink present on the receiving member 8 at the end of the recording step is so large as to present the possibility of overflowing from the receiving member 8 and contaminating inside of the printer 1 in the subsequent discharging steps.

When performed in a pre-recording period defining a time period from a time point when the recording command is received to a time point when the recording step starts, the removing step is continued until the ink amount on the receiving member 8 becomes less than the first predetermined amount see (C12, C13). When performed in a time period other than the prerecording time period, the removing step is continued until the ink amount on the receiving member 8 becomes less than the second predetermined amount (see C5, C6).

When the removing step is performed in the pre-recording period, a user needs to wait a long time before the recording step starts after the recording command is received. On the other hand, the ink cannot be removed easily, and the wiper 56*a* may fail to operate when the removing step is performed while the ink on the receiving member 8 is equal to or greater than the first predetermined amount and the ink viscosity is equal to or greater than the predetermined value. As a countermeasure, in the present embodiment, the removing step (C12) is performed before the ink on the receiving member 8 becomes equal to or greater than the first predetermined amount and the ink viscosity becomes equal to or greater than the predetermined value, and the recording step and the removing step are set to start in order that affords the shortest time possible from the receipt of the recording command to the start of the recording step.

Figure 10:
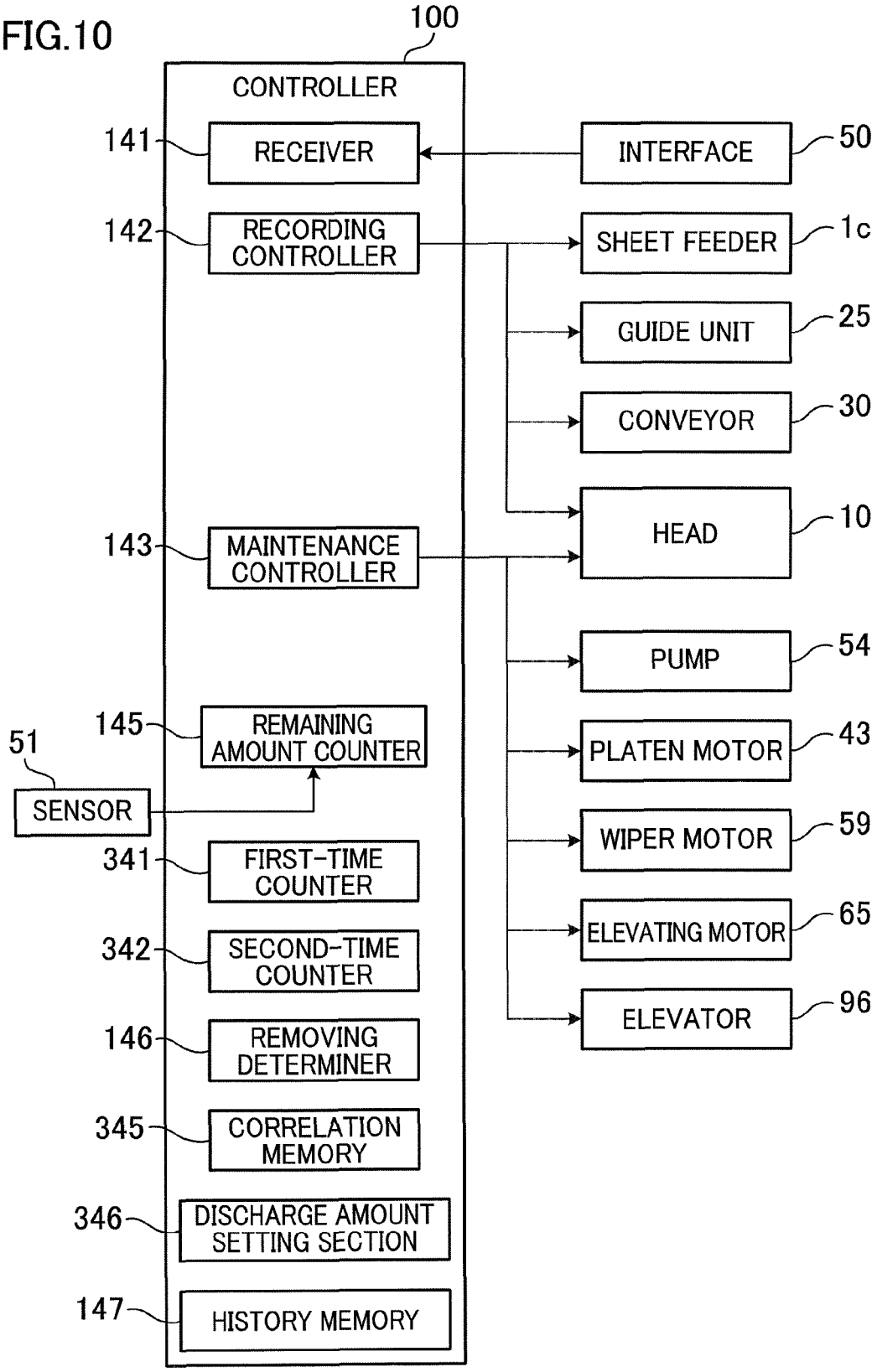
FIG. 10 is a block diagram representing the electrical configuration of the controller contained in an inkjet printer according to Third Embodiment of the present invention.
Figure 11:
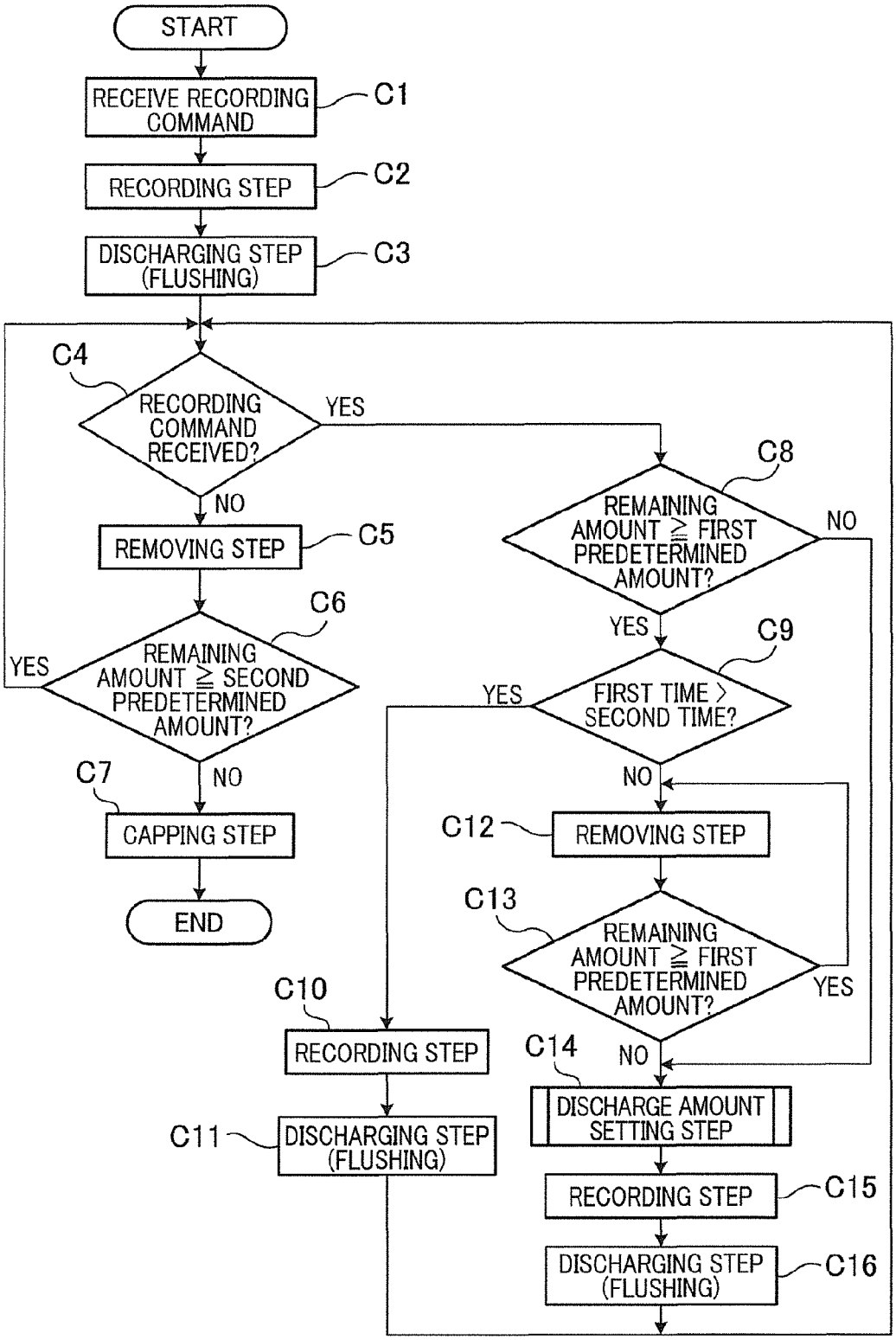
FIG. 11 is a flowchart representing a process executed by the controller shown in FIG. 10.

In the present embodiment, the functional units of the controller 100 include a receiver 141, a recording controller 142, a maintenance controller 143, a remaining amount counter 145, a first-time counter 341, a second-time counter 342, a removing determiner 146, a correlation memory 345, a discharge amount setting section 346, and a history memory 147, as represented in FIG. 10. The controller 100 does not include the discharging determiner 144.

In the present embodiment, the remaining amount counter 145 calculates the remaining amount in the pre-recording period. As used in the present embodiment, "remaining amount" means an amount of the ink expected to be present on the receiving member 8 at the start of the recording step. The amount of the ink expected to be present on the receiving member 8 at the start of the recording step is the amount of the ink expected to be present on the receiving member 8 at the start of the recording step following the pre-recording period, assuming that the removing step is not performed in the pre-recording period. In the present embodiment, the discharging step is not performed until the recording step is performed after the calculation of the remaining amount. Accordingly, the amount of the ink expected to be present on the receiving member 8 at the start of the recording step substantially coincides with the ink amount present on the receiving member 8 at the time of calculation. Thus, in the present embodiment, the remaining amount counter 145 calculates the assumed remaining amount and the dry amount as in First Embodiment, and finds the remaining amount by subtracting the dry amount from the assumed remaining amount.

In the present embodiment, "first predetermined amount" is the least ink amount on the receiving member 8 with which the viscosity of the ink on the receiving member 8 becomes less than the predetermined value prior to the removing step when the ink is discharged in a "necessary discharge amount" in the discharging step, provided that the ink has the highest possible viscosity in the environment inside the housing 1*a*. As used herein, "necessary discharge amount" is the least amount required to make the viscosity less than the predetermined value by the discharging step. When the ink on the receiving member 8 is equal to or greater than the first predetermined amount and has the highest possible viscosity that can be attained in the environment inside the housing 1*a*, the viscosity does not fall below the predetermined value prior to the removing step even when the ink is discharged in the necessary discharge amount. Presumably, this is because the surface area per unit volume of ink becomes smaller as the ink of high viscosity increases, and it takes longer for the viscosity to fall below the predetermined value after the discharge of the necessary discharge amount of ink. In other words, it is possible to make the viscosity less than the predetermined value when the ink is discharged in a specific amount in the discharging step, even when the ink has the highest possible viscosity that can be attained in the environment inside the housing 1*a*, provided that the ink on the receiving member 8 is less than the first predetermined amount. As used herein, "specific amount" is the amount slightly larger than the largest possible amount of "reference discharge amount." As used herein, "reference discharge amount" is the ink amount to be discharged in the discharging step, and it is the amount that varies with the contents of the immediately preceding recording step of the discharging step.

The first-time counter 341 calculates a "first time" defining a time period from a time point when the recording step starts to a time point when the ink viscosity on the receiving member 8 reaches the predetermined value. Specifically, the first-time counter 341 calculates the first time from the temperature and humidity detection results provided by the sensor 51, and the viscosity of the ink expected to be present at the start of the recording step. This enables an accurate calculation of the "first time". As a variation, the first-time counter 341 may calculate the first time from only one of the temperature and the humidity inside the housing 1*a*, and the viscosity of the ink expected to be present at the start of the recording step.

The second-time counter 342 calculates a "second time" defining a time period from a time point when the recording step starts to a time point when the removing step becomes ready for execution. Specifically, the second-time counter 342 calculates the second time as the sum of the time required for the recording step, and the transition time needed to bring the state of the recording step to the state of the removing step being ready for execution. In the present embodiment, the transition time is the sum of the time needed to move the platen 40 from the opposing position to the non-opposing position, and the time needed to move the receiving member 8 from the first position to the second position.

When the first time is longer than the second time, it is possible to easily remove the ink on the receiving member 8 even when the recording step is performed before the removing step, because the viscosity of the ink present on the receiving member 8 at the start of the removing step is less than the predetermined value. Thus, in the present embodiment, the recording step (C10) is performed before the removing step when the first time is longer than the second time (C9: YES).

When the first time is not longer than the second time, the ink on the receiving member 8 cannot easily be removed when the recording step is performed before the removing step, because the viscosity of the ink present on the receiving member 8 at the start of the removing step is equal to or greater than the predetermined value. Thus, in the present embodiment, the removing step (C12) is performed before the recording step (C15) when the first time is not longer than the second time.

The correlation memory 345 stores the relationship between combinations of the ink amount and the ink viscosity on the receiving member 8, and necessary discharge amount. The correlation memory 345 may store this relationship in the form of a table, or formulae for finding the relationship may be stored therein. The discharge amount setting section 346 refers to the correlation memory 345, and sets "discharge amount." The "discharge amount" is the amount of the ink that discharges through the ejection openings 108 in the discharging step performed after the recording step when the recording step is performed while the ink amount on the receiving member 8 is less than the first predetermined amount and equal to or greater than the second predetermined amount. The discharge amount setting section 346 sets the discharge amount at or above the necessary discharge amount.

An example of the process executed by the controller 100 is described below with reference to FIG. 11. At the start of the flow represented in FIG. 11, the receiving member 8 and the platen 40 are positioned in the first position and the opposing position, respectively, and the ink amount on the receiving member 8 is less than the second predetermined amount.

First, the receiver 141 receives a recording command via the interface 50 (C1). After C1, the recording controller 142 controls the sheet feeder 1*c*, the guide unit 25, the conveyor 30, and the head 10, and the recording step is performed according to the recording command (C2). Upon completion of the recording step in C2, the maintenance controller 143 controls the platen motor 43 and the elevator 96, and moves the platen 40 to the non-opposing position, and the receiving member 8 to the second position. The maintenance controller 143 then controls the head 10 for flushing, causing the head 10 to discharge ink through the ejection openings 8 in a reference discharge amount determined according to the contents of the recording step in C2 (C3).

After C3, it is determined whether the receiver 141 has received a new recording command (C4). When it is determined that the receiver 141 has not received a new recording command (C4: NO), the maintenance controller 143 controls the elevator 96, and maintains the receiving member 8 in the second position when the receiving member 8 is at the second position. The maintenance controller 143 then controls the wiper motor 59, and the removing step is performed (C5). In C5, the wiper 56*a* moves relative to the receiving member 8 only once.

After C5, the removing determiner 146 determines whether the remaining amount calculated by the remaining amount counter 145 is equal to or greater than the second predetermined amount (C6). When the remaining amount is equal to or greater than the second predetermined amount (C6: YES), the removing determiner 146 returns the process to C4. When the remaining amount is less than the second predetermined amount (C6: NO), the removing determiner 146 ends the removing step, and the process goes to C7. By performing the removing step until the ink amount on the receiving member 8 becomes less than the second predetermined amount, the ink amount on the receiving member 8 becomes less likely to be equal to or greater than the first predetermined amount in the next and subsequent discharging steps. As a result, it becomes more likely that the recording step is performed before the removing step, and it is possible to reduce the pre-recording period.

In C7, the maintenance controller 143 performs the capping step, as in A11. The routine ends after C7.

When it is determined that the receiver 141 has received a new recording command (C4: YES), the removing determiner 146 determines whether the remaining amount is equal to or greater than the first predetermined amount (C8). When the remaining amount is less than the first predetermined amount (C8: NO), the removing determiner 146 determines that the recording step should be performed before the removing step, and the process goes to C14.

When the remaining amount is equal to or greater than the first predetermined amount (C8: YES), the removing determiner 146 determines whether the first time calculated by the first-time counter 341 is longer than the second time calculated by the second-time counter 342 (C9).

When the first time is longer than the second time (C9: YES), the removing determiner 146 determines that the recording step should be performed before the removing step. The maintenance controller 143 then controls the platen motor 43 and the elevator 96, and moves the receiving member 8 to the first position, and the platen 40 to the opposing position. Then, the recording controller 142 controls the sheet feeder 1*c*, the guide unit 25, the conveyor 30, and the head 10, and the recording step is performed according to the recording command received in C4 by the receiver 141 (C10).

Upon completion of the recording step in C10, the maintenance controller 143 controls the platen motor 43 and the elevator 96, and moves the platen 40 to the non-opposing position. Because the receiving member 8 is at the first position in C10, there is no need to move the receiving member 8 in C10. The maintenance controller 143 then controls the head 10 for flushing, causing the head 10 to discharge ink through the ejection openings 108 in a reference discharge amount determined according to the contents of the recording step in C10 (C11). After C11, the maintenance controller 143 returns the process to C4.

When the first time is not longer than the second time (C9: NO), the removing determiner 146 determines that the removing step should be performed before the recording step. The maintenance controller 143 then controls the elevator 96, and moves the receiving member 8 to the second position when the receiving member 8 is at the first position, and maintains the receiving member 8 at the second position when the receiving member 8 is at the second position. Then, the maintenance controller 143 controls the wiper motor 59, and the removing step is performed (C12). In C12, the wiper 56*a* moves relative to the receiving member 8 only one.

After C12, the removing determiner 146 determines whether the remaining amount is equal to or greater than the first predetermined amount (C13). When the remaining amount is equal to or greater than the first predetermined amount (C13: YES), the removing determiner 146 returns the process to C12 to continue the removing step. When the remaining amount is less than the first predetermined amount (C13: NO), the removing determiner 146 sends the process to C14 to execute the recording step. In this manner, in the removing step performed before the recording step, the ink is removed from the receiving member 8 only in the minimum necessary amount, and it is possible to reduce the time required for the removing step. This makes it possible to shorten the pre-recording period.

In C14, the discharge amount setting section 346 sets a "discharge amount."

After C14, the maintenance controller 143 controls the platen motor 43 and the elevator 96, and moves the receiving member 8 to the third position, and the platen 40 to the opposing position. The recording controller 142 then controls the sheet feeder 1*c*, the guide unit 25, the conveyor 30, and the head 10, and the recording step is performed according to the recording command received in C4 by the receiver 141 (C15). After C15, the maintenance controller 143 controls the platen motor 43 and the elevator 96, and moves the receiving member 8 to the first position, and the platen 40 to the non-opposing position. Then, the maintenance controller 143 controls the head 10 for flushing, causing the head 10 to discharge ink through the ejection openings 108 in the discharge amount set in C14 (C16). This makes it possible to make the viscosity of the ink on the receiving member 8 less than the predetermined value, allowing the ink on the receiving member 8 to be easily removed in the removing step executed after C16. After C16, the maintenance controller 143 returns the process to C4.

The discharge amount setting step (C14) is described below with reference to FIG. 12. In the discharge amount setting step (C14), the discharge amount setting section 346 first calculates the "reference discharge amount" that varies according to the contents of the recording step based on the recording command received in C4 by the receiver 141 (D1). After D1, the discharge amount setting section 346 calculates the amount and the viscosity of the ink expected to be present on the receiving member 8 at the completion of the recording step in C15 (D2). After D2, the discharge amount setting section 346 refers to the correlation memory 345, and acquires the necessary discharge amount that corresponds to a combination of the ink amount and viscosity calculated in D2 (D3).

After D3, the discharge amount setting section 346 determines whether the reference discharge amount is equal to or greater than the necessary discharge amount (D4). When the reference discharge amount is equal to or greater than the necessary discharge amount (D4: YES), the discharge amount setting section 346 sets the "discharge amount" to "reference discharge amount" (D5). When the reference discharge amount is less than the necessary discharge amount (D4: NO), the discharge amount setting section 346 sets the "discharge amount" to "necessary discharge amount" (D6). The routine ends after D5 and D6.

In the present embodiment, the recording step (C15) is performed before the removing step (C12) when the remaining amount is less than the first predetermined amount (C8: NO), instead of performing the removing step every time the discharging step (C16) is performed. This makes it possible to make the procedure less complex.

Further, in the present embodiment, the recording step (C15) is performed before the removing step (C12) when the remaining amount is less than the first predetermined amount (C8: NO), and the remaining amount is equal to or greater than the first predetermined amount (C8: YES) and the first time is longer than the second time (C9: YES). This makes it possible to reduce the pre-recording period. Further, it becomes possible to easily remove the ink in the removing step, because the amount of the ink present on the receiving member 8 at the start of the removing step is less than the first predetermined amount, or the ink viscosity is less than the predetermined value.

Fourth Embodiment

Figure 13:
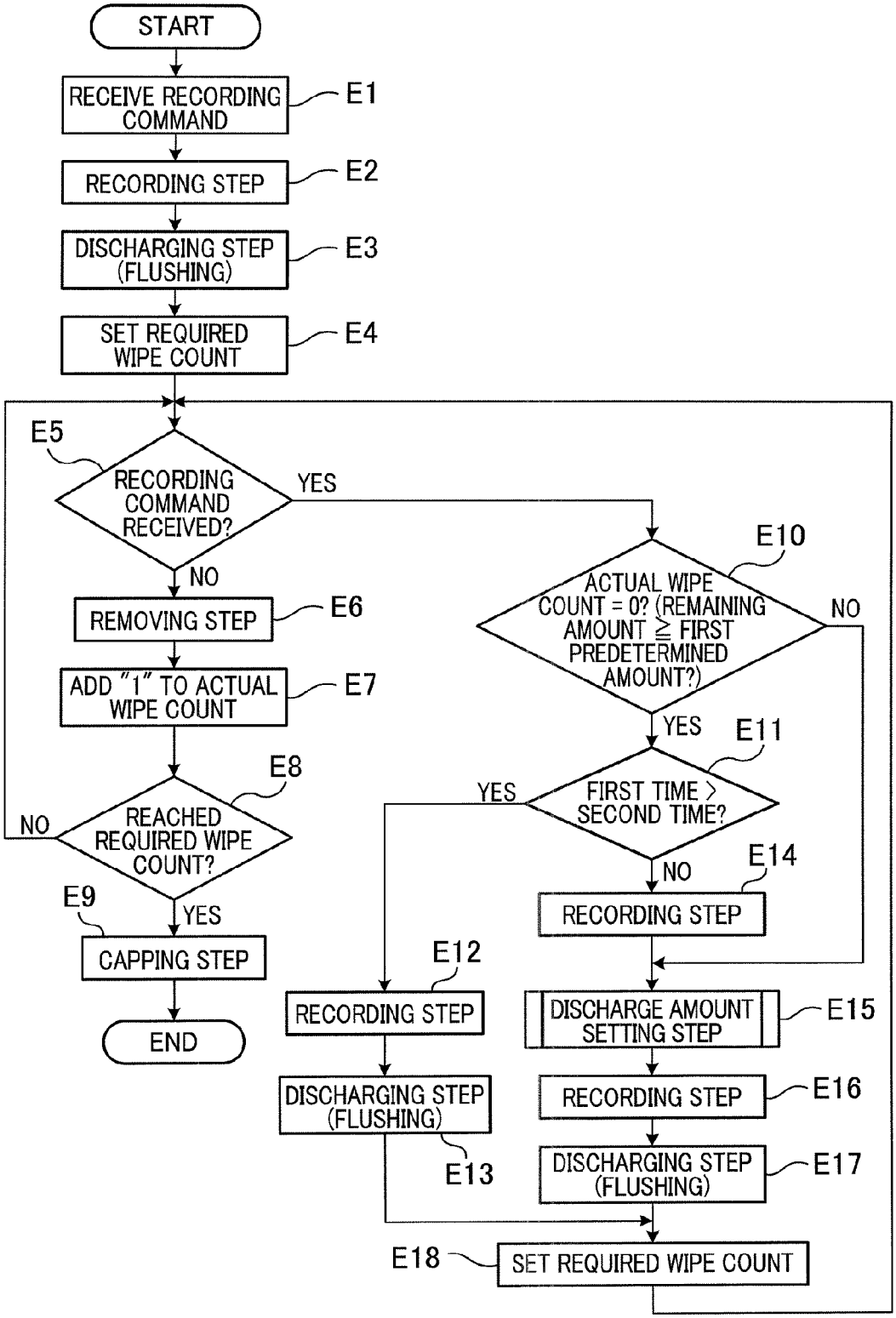
FIG. 13 is a flowchart representing a process executed by the controller contained in an inkjet printer according to Fourth Embodiment of the present invention.

Fourth Embodiment of the present invention is described below with reference to FIG. 13. The main difference between Fourth Embodiment and Third Embodiment is that the maintenance controller 143 in this embodiment sets "required wipe count" prior to the removing step. As used herein, "required wipe count" refers to the number of times the wiper 56*a* need to move relative to the receiving member 8 to make the ink amount on the receiving member 8 less than the second predetermined amount in the removing step. In the present embodiment, the structure, the relative movement rate, and the like of the wiper 56*a* are set so that the ink amount on the receiving member 8 becomes less than the second predetermined amount after a single relative movement of the wiper 56*a* with respect to the receiving member 8, irrespective of the ink amount on the receiving member 8. In the following, the elements already described in Third Embodiment are given the same reference numerals, and explanations thereof are omitted as appropriate.

In the present embodiment, the history memory 147 stores the "required wipe count" previously set by the maintenance controller 143, and the "actual wipe count" of the wiping previously performed in the removing step by the maintenance controller 143. As used herein, "actual wipe count" is the number of times the wiper 56*a* actually moved relative to the receiving member 8.

An example of the process executed by the controller 100 is described below with reference to FIG. 13.

The procedure begins with processes E1 to E3, corresponding to C1 to C3 of Third Embodiment. After E3, the remaining amount counter 145 calculates the remaining amount according to the contents of the previous discharging steps and removing steps stored in the history memory 147. The maintenance controller 143 then sets the required wipe count using the remaining amount (E4). The history memory 147 stores the required wipe count set in E4 by the maintenance controller 143, and initializes the stored actual wipe count to 0.

E4 is followed by processes E5 and E6, corresponding to C4 and C5 of Third Embodiment. After E6, the history memory 147 adds "1" to the stored actual wipe count (E7). After E7, the maintenance controller 143 determines whether the actual wipe count stored in the history memory 147 has reached the required wipe count (E8). When the actual wipe count has not reached the required wipe count (E8: NO), the maintenance controller 143 determines that the ink amount on the receiving member 8 is equal to or greater than the second predetermined amount, and returns the process to E5. When it is determined that the actual wipe count has reached the required wipe count (E8: YES), the maintenance controller 143 determines that the ink amount on the receiving member 8 is less than the second predetermined amount, and performs the process E9, which corresponds to C7 of Third Embodiment. The routine ends after E9.

When it is determined that the receiver 141 has received a new recording command (E5: YES), the removing determiner 146 determines whether the actual wipe count is 0 (E10). When the "actual wipe count is 0 (E10: YES), the removing determiner 146 determines that the remaining amount" (ink amount expected to be present on the receiving member 8 at the start of the recording step) is equal to or greater than the first predetermined amount, and the process goes to E11. When the actual wipe count is 1 or more (E10: NO), the removing determiner 146 determines that the remaining amount is less than the first predetermined amount, and the process goes to E15. E11 to E14 correspond to C9 to C12 of Third Embodiment. After E14, the maintenance controller 143 determines that the ink amount on the receiving member 8 is less than the first predetermined amount, and the process goes to E15. E15 to E17 correspond to C14 to C16 of Third Embodiment.

The process goes to E18 after E13 and E17. In E18, the remaining amount counter 145 calculates the remaining amount, using the contents of the previous discharging steps and removing steps stored in the history memory 147, as in E4. The maintenance controller 143 then sets the required wipe amount using the remaining amount. The history memory 147 stores the required wipe amount set in E18 by the maintenance controller 143, and initializes the stored actual wipe count to 0. After E18, the maintenance controller 143 returns the process to E5.

As has been described, in the present embodiment, the recording step (E16) is performed before the removing step (E14) when the remaining amount is less than the first predetermined amount (E10: NO), instead of performing the removing step every time the discharging step (E13, E17) is performed. This makes it possible to make the procedure less complex.

Further, in the present embodiment, the removing determiner 146, using the actual wipe count stored in the history memory 147, is capable of easily determining whether the remaining amount is equal to or greater than the first predetermined amount.

Fifth Embodiment

Figure 14:
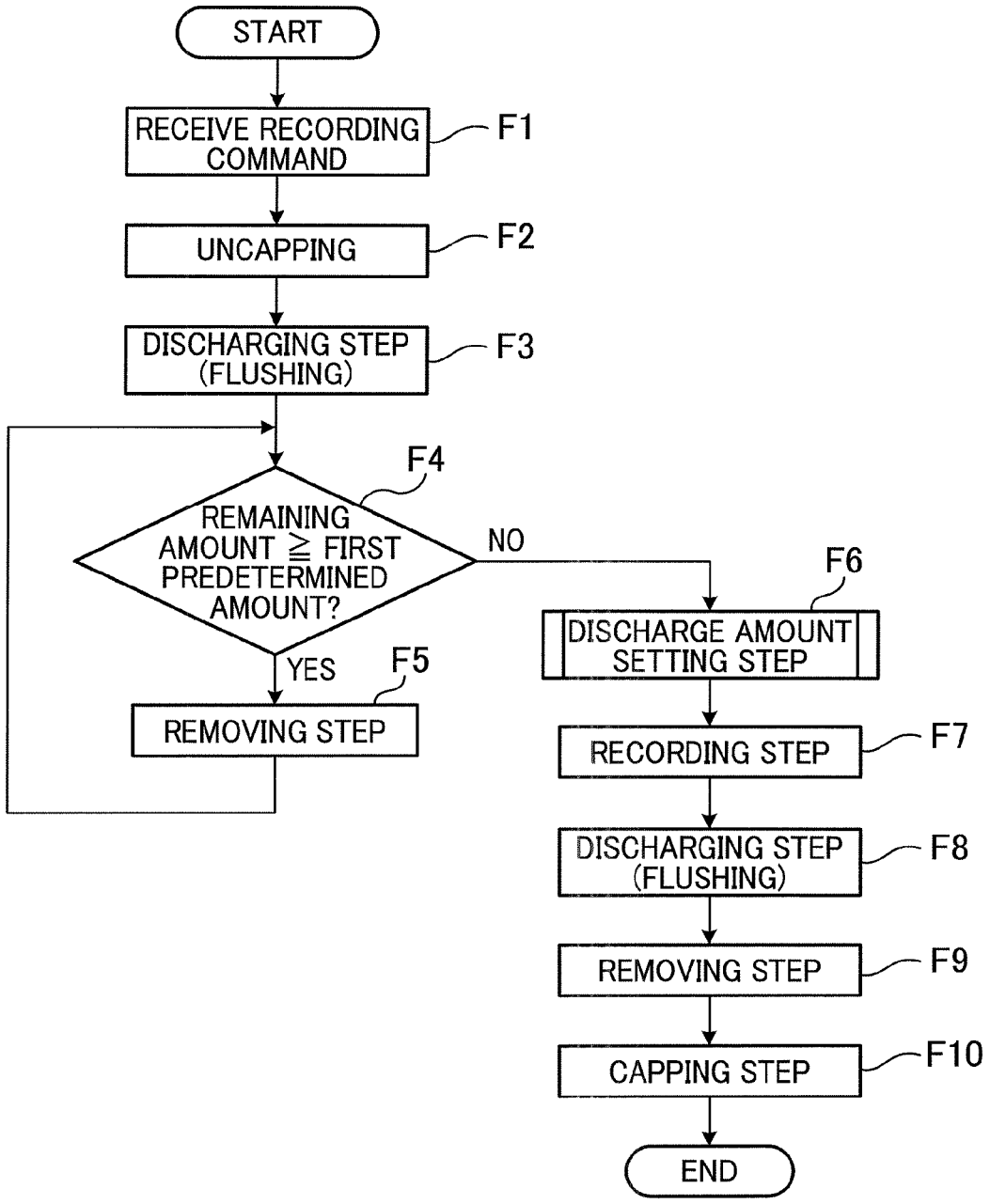
FIG. 14 is a flowchart representing a process executed by the controller contained in an inkjet printer according to Fifth Embodiment of the present invention.

Fifth Embodiment of the present invention is described below with reference to FIG. 14. Fifth Embodiment mainly differs from the Third Embodiment in that the discharging step (F3) is performed before starting the recording step based on the recording command when the recording command is received during capping, and in that the removing step (F5) is always performed before the recording step (F7) when the remaining amount is equal to or greater than the first predetermined amount (F4: YES). In the following, the elements already described in Third Embodiment are given the same reference numerals, and explanations thereof are omitted as appropriate.

An example of the process executed by the controller 100 is described below with reference to FIG. 14. At the start of the flow represented in FIG. 14, capping has been performed, and the receiving member 8 and the platen 40 are in the third position and the opposing position, respectively, with the tip 61*a* in contact with the receiving member 8.

First, the receiver 141 receives a recording command via the interface 50 (F1). After F1, the maintenance controller 143 controls the elevating motor 65 for uncapping, lifting the movable body 63 and separating the tip 61*a* from the receiving member 8 (F2). After F2, the maintenance controller 143 controls the head 10 for flushing, causing the head 10 to discharge ink through the ejection openings 108 in an amount set according to the capping time (F3). After F3, the removing determiner 146 determines whether the remaining amount is equal to or greater than the first predetermined amount (F4). When the remaining amount is equal to or greater than the first predetermined amount (F4: YES), the removing determiner 146 determines that the removing step should be performed before the recording step. The maintenance controller 143 then controls the elevator 96, and moves the receiving member 8 to the second position, and controls the wiper motor 59 to perform the removing step (F5). The removing step in F5 is performed until the ink amount on the receiving member 8 becomes less than the first predetermined amount (F4: NO).

When the remaining amount is less than the first predetermined amount (F4: NO), the removing determiner 146 sends the process to F6. F6 to F8 correspond to C14 to C16 of Third Embodiment. After F8, the maintenance controller 143 controls the elevator 96, and moves the receiving member 8 to the second position. The maintenance controller 143 then controls the wiper motor 59, and moves the wiper 56*a* relative to the receiving member 8 to perform the removing step (F9). The removing step in F9 is performed until the ink amount on the receiving member 8 becomes less than the second predetermined amount. After F9, the maintenance controller 143 controls the elevator 96 for capping, moving the receiving member 8 to the third position, and controlling the elevating motor 65 to lower the movable body 63 and bring the tip 61*a* into contact with the receiving member 8 (F10). The routine ends after F10.

As has been described above, in the present embodiment, the recording step (F7) is performed before the removing step (F9) when the remaining amount is less than the first predetermined amount (F4: NO), instead of performing the removing step every time the discharging step (F3) is performed. This makes it possible to make the procedure less complex.

Further, in the present embodiment, it is possible to simplify the substance of the control, because the process always determines that the removing step (F5) should be performed before the recording step (F7) when the remaining amount is equal to or greater than the first predetermined amount (F4: YES).

The configurations of the foregoing embodiments may be appropriately combined, or the configuration of each embodiment may be partially modified, as appropriate.

The tip 61*a* is not necessarily required to be movable. For example, the tip 61*a* may be immovably fixed to the holder 3, and its position with respect to the ejection surface 10*a* may be fixed. In this case, the tip 61*a* is in contact with the receiving member 8 when the receiving member 8 is at the third position.

In First and Second Embodiments, the determination as to whether the discharging step is needed is made by the discharging determiner 144 in each intermediate period of a continuous recording. However, the determination as to whether the discharging step needs to be performed in each intermediate period of a continuous recording may be made in advance before the continuous recording is started. Similarly, the determination made by the removing determiner 146 as to whether the removing step needs to be performed in each intermediate period of a continuous recording may be made in advance before the continuous recording is started.

In First and Second Embodiments, the removing step may be performed in any intermediate period, and the intermediate period in which the removing step is performed is not limited to the intermediate period in which the discharging step was performed, provided that the removing step is performed in an intermediate period that occurs before the next discharging step is performed following the current discharging step.

In First Embodiment, ink may discharge through all the ejection openings 108 in the discharging step performed in the intermediate period, as in Second Embodiment, rather than being discharged through only the ejection openings 108 in which the no ejection period is equal to or greater than the predetermined time period.

In Third to Fifth Embodiments, the discharging step may be executable in the time period from the calculation of the remaining amount to the start of the recording step. In this case, the remaining amount counter 145 may calculate the remaining amount as the sum of the ink amount present on the receiving member 8 at the time of calculation, and the expected discharge amount.

Figure 12:
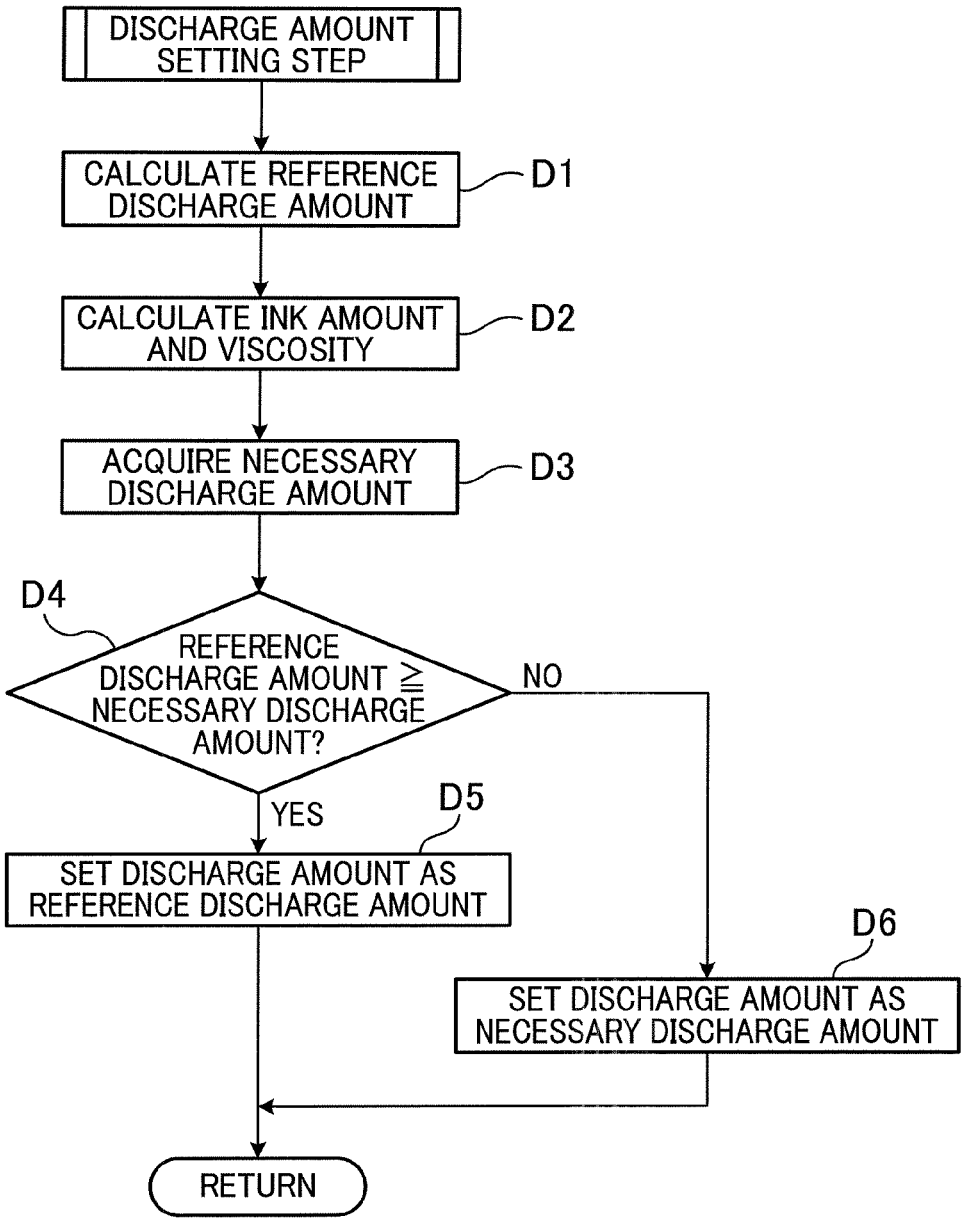
FIG. 12 is a flowchart concerning a discharge amount setting step represented in FIG. 11.

In Third to Fifth Embodiments, the discharge amount may always be used as the reference discharge amount, or may be obtained by adding a certain amount to the reference discharge amount, without performing the discharge amount setting step (see FIG. 12).

The recording command is not necessarily required to contain image data. For example, the controller 100 may start the recording step upon receipt of image data, and a recording command instructing recording of the image data in paper P. In this case, the interface receiving the recording command may be different from the interface receiving the image data. For example, the interface receiving the recording command may be a touch panel provided on the printer. In this way, a user is able to operate the touch panel and output a recording command to the receiver.

The liquid ejection apparatus according to the present invention may be structured to be capable of simultaneously executing the recording step and the removing step.

The remover may have any configuration, provided that the remover is capable of removing the ink from the receiving member.

The remaining amount counter 145 may calculate the remaining amount without taking into account the dry amount.

The controller 100 may be configured from a single CPU. Alternatively, the controller 100 may be configured from a plurality of CPUs, a specific ASIC (application specific integrated circuit), or a combination of CPU and specific ASIC.

The present invention is also applicable to serial inkjet printers. Further, the present invention is not limited to printers, and is applicable to facsimiles, copiers, and the like. The present invention is also applicable to liquid ejection apparatuses that eject liquid other than ink. The liquid ejection method is not particularly limited, and any method may be used. The recording medium is not limited to paper P, and may be any type of recordable medium.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus, comprising:

a head including a plurality of ejection openings for ejecting a liquid;

a conveyor configured to convey a recording medium in a conveyance direction through an opposing region opposite the ejection openings;

an annular member configured to surround the head;

a discharger configured to discharge the liquid through at least one of the ejection openings;

a receiving member configured to receive the liquid discharged through at least one of the ejection openings;

a remover configured to remove the liquid on the receiving member;

a memory configured to store information about liquid discharge by the discharger and liquid removal by the remover;

a sensor configured to detect at least one of temperature and humidity inside the liquid ejection apparatus; and a controller configured to:

(a) control the head according to a recording command received to eject the liquid through the ejection openings toward a recording medium;

(b) control the discharger to discharge the liquid toward the receiving member through at least one of the ejection openings;

(c') calculate a liquid amount on the receiving member, by subtracting an amount of the liquid that dries over time on the receiving member using a result of the detection of the sensor, from an amount derived from at least the information stored in the memory based at least on an amount of the liquid discharged onto the receiving member in the step (b);

(c) determine whether the liquid amount calculated in the step (c') is equal to or greater than a first predetermined amount;

(d) control the remover to remove the liquid on the receiving member;

perform the step (a) before the step (d) when it is determined in the step (c) that the liquid amount is less than the first predetermined amount;

(e) control the conveyor according to the recording command to continuously convey a plurality of recording media passing through the opposing region;

(f) determine whether the step (b) needs to be performed in each of a plurality of intermediate periods, the intermediate period defining a time period from a time point when an upstream end of the recording medium with respect to the conveyance direction passes the opposing region to a time point when a downstream end of the next recording medium with respect to the conveyance direction reaches the opposing region in the step (e);

(g) perform the step (b) in the intermediate period for which the step (b) is determined as being necessary in the step (f);

perform the step (c') and (c) after the step (g), and, when it is determined in the step (c) that the liquid amount is equal to or greater than the first predetermined amount, perform the step (d) to make the amount of the liquid on the receiving member less than the first predetermined amount, the step (d) being performed in the intermediate period that occurs after the step (g) and before the step (b) is performed next;

(h) perform the step (d), after the step (e) is finished, to make the amount of the liquid on the receiving member less than a second predetermined amount smaller than the first predetermined amount; and (i) control at least one of the annular member and the receiving member after the step (h) to bring a tip of the annular member into contact with the receiving member and cap the ejection openings with the annular member and the receiving member.

2. The liquid ejection apparatus according to claim 1, wherein the liquid amount is based on an amount of the liquid already discharged onto the receiving member in the step (b), and an amount of the liquid to be discharged onto the receiving member in the step (b) yet to be performed.

3. The liquid ejection apparatus according to claim 1, comprising a conveyor configured to convey the recording medium in a conveyance direction through an opposing region opposite the ejection openings, wherein, the liquid amount is based on an amount of the liquid already discharged onto the receiving member in the step (b), and an amount of the liquid to be discharged onto the receiving member in the step (b) yet to be performed, and the controller is configured to:

(e) control the conveyor according to the recording command to continuously convey a plurality of recording media passing through the opposing region;

(f) determine whether the step (b) needs to be performed in each of a plurality of intermediate periods, the intermediate period defining a time period from a time point when an upstream end of the recording medium with respect to the conveyance direction passes the opposing region to a time point when a downstream end of the next recording medium with respect to the conveyance direction reaches the opposing region in the step (e);

(g) perform the step (b) in the intermediate period for which the step (b) is determined as being necessary in the step (f); and perform the step (c') and (c) before the step (g), and, when it is determined in the step (c) that the liquid amount is equal to or greater than the first predetermined amount, perform the step (d) to make the amount of the liquid on the receiving member less than the first predetermined amount, and then perform the step (g).

4. The liquid ejection apparatus according to claim 1, comprising a conveyor configured to convey the recording medium through an opposing region opposite the ejection openings, wherein, the controller is configured to control the conveyor and the head in a manner not allowing the recording medium to be positioned in the opposing region and the liquid to be ejected through the ejection openings while the step (d) is being performed.

5. The liquid ejection apparatus according to claim 1, comprising a conveyor configured to convey the recording medium through an opposing region opposite the ejection openings, wherein, the head is a line head that ejects the liquid through the ejection openings in the state of being fixed to a predetermined position, and the controller is configured to control at least one of the remover and the head to position the remover at the opposing region while the step (d) is being performed.

6. The liquid ejection apparatus according to claim 1, wherein the controller is configured to perform the step (d) after the step (e) is finished and for a time length longer than a time length when the step (d) is performed in the intermediate period.

7. The liquid ejection apparatus according to claim 1, comprising a conveyor configured to convey the recording medium in a conveyance direction through an opposing region opposite the ejection openings, wherein, the controller is configured to:

(e) control the conveyor according to the recording command to continuously convey a plurality of recording media passing through the opposing region;

(f') determine whether the step (b) needs to be performed for all of the ejection openings in each of a plurality of intermediate periods, the intermediate period defining a time period from a time point when an upstream end of the recording medium with respect to the conveyance direction passes the opposing region to a time point when a downstream end of the next recording medium with respect to the conveyance direction reaches the opposing region in the step (e);

(g') perform the step (b) for all of the ejection openings in the intermediate period for which the step (b) is determined as being necessary for all of the ejection openings in the step (f'); and determine that the step (b) needs to be performed for all of the ejection openings in the intermediate period that occurs first after an elapsed time period equal to or greater than a predetermined time period from the end of the step (g').

8. The liquid ejection apparatus according to claim 1, wherein the discharger includes an actuator configured to apply a pressure to the liquid inside the head for causing a liquid to be ejected through each of the ejection openings, and wherein the controller is configured to control the actuator to selectively discharge the liquid through the ejection openings in the step (b).

9. The liquid ejection apparatus according to claim 1, further comprising a sensor configured to detect at least one of temperature and humidity inside the liquid ejection apparatus, wherein, the controller is configured to calculate the liquid amount using a result of the detection by the sensor, taking into account an amount of the liquid that dries over time on the receiving member.

10. The liquid ejection apparatus according to claim 1, wherein the controller is configured to perform the step (c') and (c) in a pre-recording period defining a time period from a time point when the recording command is received to a time point when the step (a) starts, using as the liquid amount an amount of the liquid expected to be present on the receiving member at the start of the step (a).

11. The liquid ejection apparatus according to claim 1, wherein the controller is configured to perform the following when it is determined in the step (c) that the liquid amount is equal to or greater than the first predetermined amount:

(j) calculate a first time defining a time period from a time point when the step (a) starts to a time point when the viscosity of the liquid on the receiving member reaches a predetermined value;

(k) calculate a second time defining a time period from a time point when the step (a) starts to a time point when the step (d) becomes ready for execution;

(l) determine whether the first time is longer than the second time;

perform the step (a) before the step (d) when it is determined in the step (l) that the first time is longer than the second time; and perform the step (d) before the step (a) when it is determined in the step (l) that the first time is not longer than the second time.

12. The liquid ejection apparatus according to claim 11, wherein the controller is configured to calculate the first time in the step (j) using at least one of temperature and humidity inside the liquid ejection apparatus, and using the viscosity of the liquid expected to be present on the receiving member at the start of the step (a).

13. The liquid ejection apparatus according to claim 1, wherein the controller is configured to perform the step (d) before the step (a) when it is determined in the step (c) that the liquid amount is equal to or greater than the first predetermined amount.

14. The liquid ejection apparatus according to claim 1, wherein the controller is configured to:

control the remover to make the amount of the liquid on the receiving member less than the first predetermined amount when the step (d) is performed in a pre-recording period defining a time period from a time point when the recording command is received to a time point when the step (a) starts; and control the remover to make the amount of the liquid on the receiving member less than a second predetermined amount smaller than the first predetermined amount when the step (d) is performed in a time period other than the pre-recording period.

15. The liquid ejection apparatus according to claim 14, wherein the remover includes a removing member configured to remove the liquid on the receiving member in a relative movement with respect to the receiving member and in contact with the receiving member, and wherein controller is configured to:

control the removing member to move relative to the receiving member in numbers needed to make the amount of the liquid on the receiving member less than the first predetermined amount when the step (d) is performed in the pre-recording period; and control the removing member to move relative to the receiving member in numbers needed to make the amount of the liquid on the receiving member less than the second predetermined amount when the step (d) is performed in the time period other than the pre-recording period.

16. The liquid ejection apparatus according to claim 1, wherein the controller is configured to perform the following when the step (b) is performed after the step (a) is finished and before the step (d) performed for the first time after the step (a) is finished:

control the discharger to discharge the liquid through at least one of the ejection openings in a reference discharge amount determined according to the contents of the step (a) when the step (a) is performed while the amount of the liquid on the receiving member is less than a second predetermined amount smaller than the first predetermined amount; and control the discharger to discharge the liquid through at least one of the ejection openings in an amount equal to or greater than the reference discharge amount and needed to make the viscosity of the liquid on the receiving member less than a predetermined value when the step (a) is performed while the amount of the liquid on the receiving member is less than the first predetermined amount and equal to or greater than the second predetermined amount.

17. The liquid ejection apparatus according to claim 1, comprising a conveyor configured to convey the recording medium through an opposing region opposite the ejection openings, wherein, the head is a line head that ejects the liquid through the ejection openings in the state of being fixed to a predetermined position, and the receiving member is positioned at the opposing region.

18. A non-transitory storage medium storing a program for causing a liquid ejection apparatus to execute a process, the liquid ejection apparatus comprising:

a head including a plurality of ejection openings for ejecting a liquid;

a conveyor configured to convey a recording medium in a conveyance direction through an opposing region opposite the ejection openings;

an annular member configured to surround the head;

a discharger configured to discharge the liquid through at least one of the ejection openings;

a receiving member configured to receive the liquid discharged through at least one of the ejection openings;

a remover configured to remove the liquid on the receiving member;

a sensor configured to detect at least one of temperature and humidity inside the liquid ejection apparatus; and a memory configured to store information about liquid discharge by the discharger and liquid removal by the remover, the process comprising the steps of:

(a) controlling the head according to a recording command received to eject the liquid through the ejection openings toward a recording medium;

(b) controlling the discharger to discharge the liquid toward the receiving member through at least one of the ejection openings;

(c') calculate a liquid amount on the receiving member, by subtracting an amount of the liquid that dries over time on the receiving member using a result of the detection of the sensor, from an amount derived from at least the information stored in the memory based at least on an amount of the liquid discharged onto the receiving member in the step (b);

(c) determining whether the liquid amount calculated in the step (c') is equal to or greater than a first predetermined amount;

(d) controlling the remover to remove the liquid on the receiving member;

performing the step (a) before the step (d) when it is determined in the step (c) that the liquid amount is less than the first predetermined amount;

(e) controlling the conveyor according to the recording command to continuously convey a plurality of recording media passing through the opposing region;

(f) determining whether the step (b) needs to be performed in each of a plurality of intermediate periods, the intermediate period defining a time period from a time point when an upstream end of the recording medium with respect to the conveyance direction passes the opposing region to a time point when a downstream end of the next recording medium with respect to the conveyance direction reaches the opposing region in the step (e);

(g) performing the step (b) in the intermediate period for which the step (b) is determined as being necessary in the step (f);

performing the step (c') and (c) after the step (g), and, when it is determined in the step (c) that the liquid amount is equal to or greater than the first predetermined amount, perform the step (d) to make the amount of the liquid on the receiving member less than the first predetermined amount, the step (d) being performed in the intermediate period that occurs after the step (g) and before the step (b) is performed next;

(h) performing the step (d), after the step (e) is finished, to make the amount of the liquid on the receiving member less than a second predetermined amount smaller than the first predetermined amount; and (i) controlling at least one of the annular member and the receiving member after the step (h) to bring a tip of the annular member into contact with the receiving member and cap the ejection openings with the annular member and the receiving member.

19. A method of controlling a liquid ejection apparatus, the liquid ejection apparatus comprising:

a head including a plurality of ejection openings for ejecting a liquid;

a conveyor configured to convey a recording medium in a conveyance direction through an opposing region opposite the ejection openings;

an annular member configured to surround the head;

a discharger configured to discharge the liquid through at least one of the ejection openings;

a receiving member configured to receive the liquid discharged through at least one of the ejection openings;

a remover configured to remove the liquid on the receiving member;

a sensor configured to detect at least one of temperature and humidity inside the liquid ejection apparatus; and a memory configured to store information about liquid discharge by the discharger and liquid removal by the remover, the method comprising the steps of:

(a) controlling the head according to a recording command received to eject the liquid through the ejection openings toward a recording medium;

(b) controlling the discharger to discharge the liquid toward the receiving member through at least one of the ejection openings;

(c') calculate a liquid amount on the receiving member, by subtracting an amount of the liquid that dries over time on the receiving member using a result of the detection of the sensor, from an amount derived from at least the information stored in the memory based at least on an amount of the liquid discharged onto the receiving member in the step (b);

(c) determining whether the liquid amount calculated in the step (c') is equal to or greater than a first predetermined amount;

(d) controlling the remover to remove the liquid on the receiving member;

performing the step (a) before the step (d) when it is determined in the step (c) that the liquid amount is less than the first predetermined amount;

(e) controlling the conveyor according to the recording command to continuously convey a plurality of recording media passing through the opposing region;

(f) determining whether the step (b) needs to be performed in each of a plurality of intermediate periods, the intermediate period defining a time period from a time point when an upstream end of the recording medium with respect to the conveyance direction passes the opposing region to a time point when a downstream end of the next recording medium with respect to the conveyance direction reaches the opposing region in the step (e);

(g) performing the step (b) in the intermediate period for which the step (b) is determined as being necessary in the step (f);

performing the step (c') and (c) after the step (g), and, when it is determined in the step (c) that the liquid amount is equal to or greater than the first predetermined amount, perform the step (d) to make the amount of the liquid on the receiving member less than the first predetermined amount, the step (d) being performed in the intermediate period that occurs after the step (g) and before the step (b) is performed next;

(h) performing the step (d), after the step (e) is finished, to make the amount of the liquid on the receiving member less than a second predetermined amount smaller than the first predetermined amount; and (i) controlling at least one of the annular member and the receiving member after the step (h) to bring a tip of the annular member into contact with the receiving member and cap the ejection openings with the annular member and the receiving member.

* * * * *